US012698172B2

(12) United States Patent
Umi

(10) Patent No.: US 12,698,172 B2
(45) Date of Patent: Aug. 4, 2026

(54) MEDIUM CONVEYING APPARATUS, MEDIUM CONVEYING METHOD, AND COMPUTER-READABLE NON-TRANSITORY MEDIUM

(71) Applicant: PFU LIMITED, Kahoku (JP)

(72) Inventor: Takayuki Umi, Kahoku (JP)

(73) Assignee: PFU LIMITED, Kahoku (JP)

( * ) Notice: Subject to any disclaimer, the term of this patent is extended or adjusted under 35 U.S.C. 154(b) by 0 days.

(21) Appl. No.: 18/982,844

(22) Filed: Dec. 16, 2024

(65) Prior Publication Data

US 2025/0206554 A1 Jun. 26, 2025

(30) Foreign Application Priority Data

Dec. 26, 2023 (JP) ..... 2023-220038

(51) Int. Cl.
*B65H 7/14* (2006.01)
*B65H 7/02* (2006.01)
*B65H 7/20* (2006.01)

(52) U.S. Cl.
CPC ..... *B65H 7/14* (2013.01); *B65H 7/02* (2013.01); *B65H 7/20* (2013.01); *B65H 2220/01* (2013.01); *B65H 2220/02* (2013.01); *B65H 2220/03* (2013.01); *B65H 2511/11* (2013.01); *B65H 2511/22* (2013.01); *B65H 2511/514* (2013.01); *B65H 2553/82* (2013.01); *B65H 2701/1311* (2013.01); *B65H 2701/1313* (2013.01); *B65H 2801/12* (2013.01)

(58) Field of Classification Search
CPC .... B65H 7/14; B65H 7/02; B65H 2701/1311; B65H 2511/11; B65H 2511/22; B65H 2701/1313
USPC ..... 271/10.03
See application file for complete search history.

(56) References Cited

U.S. PATENT DOCUMENTS 6,794,633 B2 * 9/2004 Iwasaki ..... B65H 7/14 250/221
6,834,178 B2 * 12/2004 Takeda ..... G03G 15/65 399/388
7,883,083 B2 * 2/2011 Fukasawa ..... B65H 3/0684 271/110
8,444,135 B2 * 5/2013 Morita ..... B65H 3/0607 271/265.01
11,485,596 B2 * 11/2022 Namiki ..... B65H 7/125

FOREIGN PATENT DOCUMENTS

JP 2013-112517 A 6/2013

* cited by examiner

*Primary Examiner* — Jeremy R Severson
(74) *Attorney, Agent, or Firm* — Womble Bond Dickinson (US) LLP

(57) ABSTRACT

A medium conveying apparatus includes a feed roller to feed a medium, a conveyance roller pair located downstream from the feed roller in a medium conveying direction, a sensor located downstream from the conveyance roller pair in the medium conveying direction, and circuitry to start feeding a next medium when the medium is conveyed by a predetermined amount after a leading end of the medium passes the sensor.

8 Claims, 12 Drawing Sheets

MEDIUM CONVEYING APPARATUS, MEDIUM CONVEYING METHOD, AND COMPUTER-READABLE NON-TRANSITORY MEDIUM

CROSS-REFERENCE TO RELATED APPLICATIONS

This patent application is based on and claims priority pursuant to 35 U.S.C. § 119(a) to Japanese Patent Application No. 2023-220038, filed on Dec. 26, 2023, in the Japan Patent Office, the entire disclosure of which is hereby incorporated by reference herein.

BACKGROUND

The present disclosure relates to a medium conveying apparatus, a medium conveying method, and a computer-readable non-transitory medium.

A known medium conveying apparatus such as a scanner sequentially feeds and conveys multiple media. Such a medium conveying apparatus starts feeding another medium (next medium) before completing the reading and conveying of the medium fed immediately before to complete the reading and conveying of the multiple media in a shorter time.

A known automatic sheet feeding apparatus estimates a maximum sheet length from the detection of a sheet length sensor that detects the sheet length of a sheet placed on a sheet tray. Such an automatic sheet feeding apparatus starts a sheet feeding operation for the next sheet when determining that the trailing end of the current sheet has passed the position of the sheet feeding roller that feeds the sheets based on the estimated maximum sheet length.

SUMMARY

A medium conveying apparatus according to one aspect of the present disclosure includes a feed roller to feed a medium, a conveyance roller pair located downstream from the feed roller in a medium conveying direction, a sensor located downstream from the conveyance roller pair in the medium conveying direction, and circuitry to start feeding a next medium when the medium is conveyed by a predetermined amount after a leading end of the medium passes the sensor.

A medium conveying method according to one aspect of the present disclosure includes feeding a medium by a feed roller, and starting to feed a next medium when the medium is conveyed by a predetermined amount after a leading end of the medium passes a sensor located downstream from a conveyance roller pair in a medium conveying direction. The conveyance roller pair is located downstream from the feed roller in the medium conveying direction.

A computer-readable non-transitory medium according to one aspect of the present disclosure stores a computer program. The computer program causes a medium conveying apparatus including a feed roller to feed a medium, a conveyance roller pair located downstream from the feed roller in a medium conveying direction, and a sensor located downstream from the conveyance roller pair in the medium conveying direction, to execute a process. The process includes starting to feed a next medium when the medium is conveyed by a predetermined amount after a leading end of the medium passes a sensor.

BRIEF DESCRIPTION OF THE DRAWINGS

A more complete appreciation of embodiments of the present disclosure and many of the attendant advantages and features thereof can be readily obtained and understood from the following detailed description with reference to the accompanying drawings, wherein.

Figure 1:
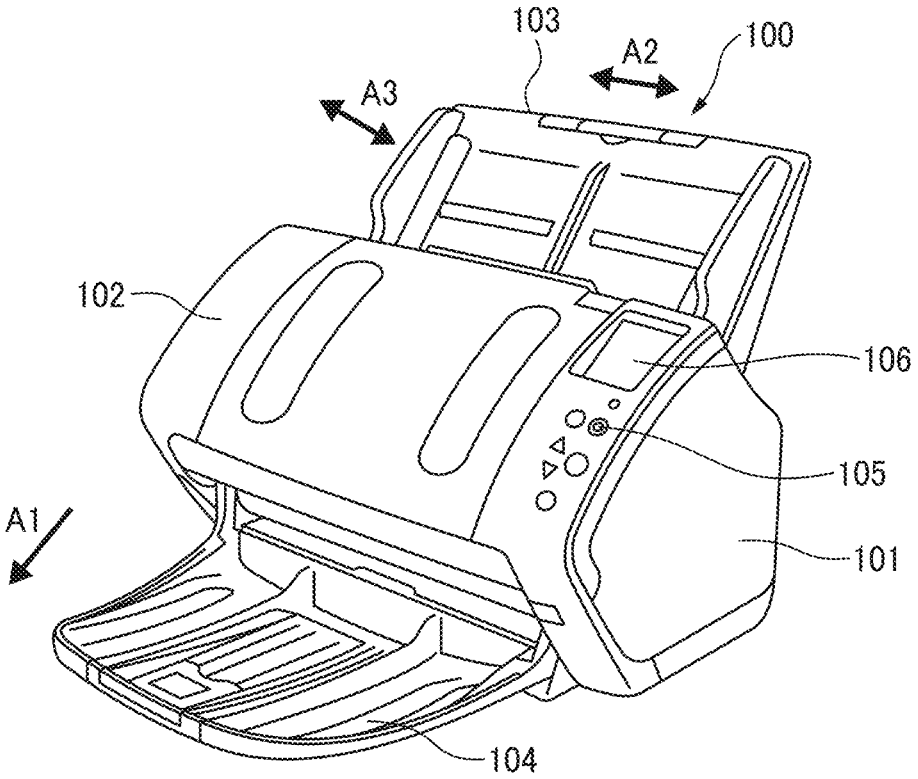
FIG. 1 is a perspective view of a medium conveying apparatus according to an embodiment.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Referring now to the drawings, embodiments of the present disclosure are described below. As used herein, the singular forms "a," "an," and "the" are intended to include the plural forms as well, unless the context clearly indicates otherwise.

A medium conveying apparatus, a medium conveying method, and a control program according to an aspect of the present disclosure are described below with reference to the drawings. The technical scope of the present disclosure is not limited to the embodiments described below and encompasses the scope of the appended claims and the equivalents thereof.

FIG. 1 is a perspective view of a medium conveying apparatus 100 as an image scanner.

The medium conveying apparatus 100 conveys media that are documents and images the media. Examples of the media include paper, cardboard, cards, booklets, and passports. The medium conveying apparatus 100 may be a facsimile machine, a copier, or a multifunction peripheral (MFP). The media to be conveyed may be printing material (e.g., paper sheets) instead of documents, and the medium conveying apparatus 100 may be a printer.

In FIG. 1, Arrow A1 indicates the direction in which a medium is conveyed and may be referred to as a "medium conveying direction A1" in the following description. Arrow A2 indicates the width direction perpendicular to the medium conveying direction. In the following description, the term "upstream" refers to upstream in the medium conveying direction A1, and the term "downstream" refers to downstream in the medium conveying direction A1.

The medium conveying apparatus 100 includes a lower housing 101, an upper housing 102, a media tray 103, an ejection tray 104, an operation device 105, and a display device 106.

The upper housing 102 is located to cover the upper face of the medium conveying apparatus 100 and engaged with the lower housing 101 with a hinge such that the upper housing 102 can be opened and closed for removing a jammed medium or cleaning the inside of the medium conveying apparatus 100.

The media tray 103 is engaged with the lower housing 101. Media to be fed and conveyed are placed on the media tray 103. The ejection tray 104 is engaged with the upper housing 102 and stacks ejected media. The ejection tray 104 may be engaged with the lower housing 101.

The operation device 105 includes an input device such as buttons and an interface circuit that acquires signals from the input device. The operation device 105 receives an input operation performed by a user and outputs an operation signal corresponding to the input operation. The display device 106 includes a display and an interface circuit that outputs image data to the display and displays image data on the display. Examples of the display include a liquid crystal display and an organic electroluminescent (EL) display.

Figure 2:
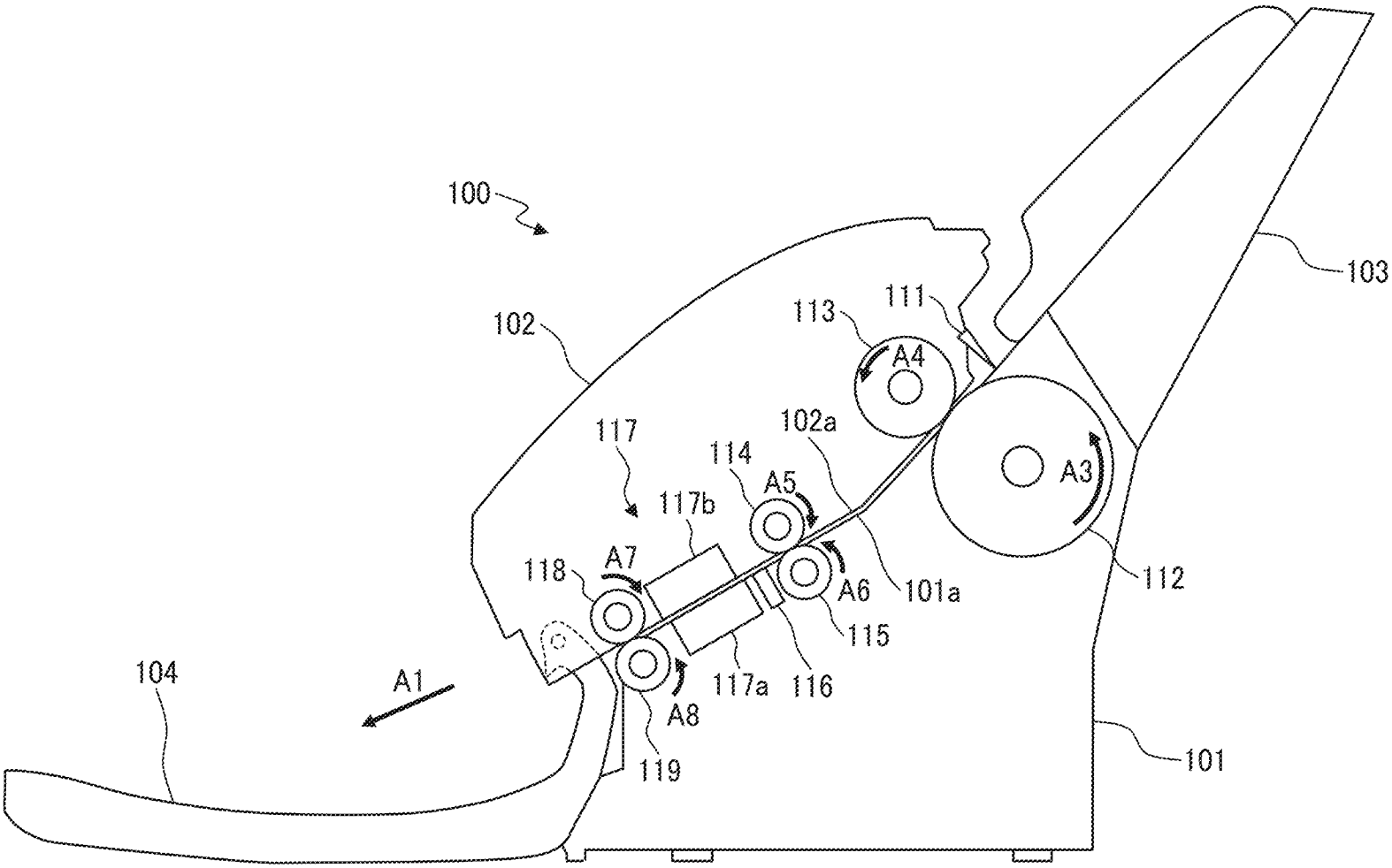
FIG. 2 is a diagram for explaining a conveyance path inside the medium conveying apparatus of FIG. 1.

FIG. 2 is a diagram for explaining a conveyance path inside the medium conveying apparatus 100.

The medium conveying apparatus 100 includes a media placement sensor 111, a feed roller 112, a separation roller 113, a first conveyance roller 114, a second conveyance roller 115, a media sensor 116, an imaging device 117, a third conveyance roller 118, and a fourth conveyance roller 119 along the media conveyance path. The imaging device 117 includes an imaging sensor.

A pair of the first conveyance roller 114 and the second conveyance roller 115 or a pair of the third conveyance roller 118 and the fourth conveyance roller 119 is an example of a conveyance roller pair. The number of each of the feed roller 112, the separation roller 113, the first conveyance roller 114, the second conveyance roller 115, the third conveyance roller 118, and the fourth conveyance roller 119 is not limited to one and may be plural. When the number of the feed roller 112, the separation roller 113, the first conveyance roller 114, the second conveyance roller 115, the third conveyance roller 118, or the fourth conveyance roller 119 is plural, the rollers are aligned and spaced apart in the width direction A2.

The medium conveying apparatus 100 has a so-called straight path. The upper face of the lower housing 101 forms a lower guide 101*a* for the medium conveyance path. The lower face of the upper housing 102 forms an upper guide 102*a* for the medium conveyance path.

The media placement sensor 111 is located upstream from the feed roller 112 and the separation roller 113 and detects whether a medium is placed on the media tray 103. The media placement sensor 111 is a contact detection sensor that includes an arm, a light emitter, and a light receiver. The arm is movable by contact with the medium. The light emitter and the light receiver are located facing each other with the arm in between. The light emitter is, for example, a light-emitting diode (LED) and emits light toward the light receiver. The light receiver is, for example, a photodiode and receives light emitted by the light emitter. The arm blocks the light emitted from the light emitter to the light receiver in one of two states, either when the arm is in contact with a medium or when the arm is not in contact with a medium. In the other state, the arm does not block the light emitted from the light emitter to the light receiver. The media placement sensor 111 generates and outputs a placement signal whose signal value changes depending on whether the arm is in contact with a medium. That is, the signal value of the placement signal changes depending on whether a medium is placed on the media tray 103.

The media placement sensor 111 may be any sensor that can detect the presence of a medium, such as a light detection sensor including a light emitter to emit light to or from the media tray 103 and a light receiver to detect light emitted by the light emitter and reflected by a medium placed on the media tray 103.

The feed roller 112 is in the lower housing 101 and sequentially separates and feeds media on the media tray 103 one by one from the bottom. The separation roller 113 is a so-called brake roller or retard roller and is located in the upper housing 102 to face the feed roller 112. The separation roller 113 can be stopped or rotated in a direction A4 opposite the medium feeding direction. Instead of the separation roller 113, a separation pad may be used. The feed roller 112 and the separation roller 113 function as a separator that separates media.

The first conveyance roller 114 and the second conveyance roller 115 are located downstream from the feed roller 112 in the medium conveying direction A1 and face each other. The first conveyance roller 114 and the second conveyance roller 115 convey a medium fed by the feed roller 112 and the separation roller 113 to the imaging device 117.

The media sensor 116 is an example of a detection unit and detects a medium conveyed to the position of the media sensor 116. The media sensor 116 is located downstream from the first conveyance roller 114 and the second conveyance roller 115 and upstream from the imaging device 117 in the medium conveying direction A1. The media sensor 116 may be located downstream from the imaging device 117 and upstream from the third conveyance roller 118 and the fourth conveyance roller 119 in the medium conveying direction A1. The media sensor 116 may be located downstream from the third conveyance roller 118 and the fourth conveyance roller 119 in the medium conveying direction A1.

The media sensor 116 includes a light emitter, a light receiver, and a light guide. The light emitter and the light receiver are located on one side of the medium conveyance path. The light guide faces the light emitter and the light receiver across the medium conveyance path. The light emitter is, for example, an LED and emits light toward the medium conveyance path. The light receiver is, for example, a photodiode and detects (receives) the light emitted by the light emitter and guided by the light guide. When a medium is present at a position facing at least one of the light emitter and the light receiver, the light emitted from the light emitter is blocked by the medium, and the light receiver does not detect the light emitted from the light emitter. The media sensor 116 generates and outputs a media signal whose signal value changes depending on whether a medium is present at the position of the media sensor 116 based on the intensity of light received by the light receiver.

As described above, the media sensor 116 is a light detection sensor that emits light toward the medium conveyance path and detects the received light. In general, in a contact detection sensor that includes an arm or similar component that comes into contact with a medium, the arm or similar component may wear due to contact with the medium. The medium conveying apparatus 100 can enhance the durability of the components by using a light detection sensor as the media sensor 116, compared to using a contact detection sensor. Further, in a contact detection sensor, chattering may occur when the arm comes into contact with a medium. The medium conveying apparatus 100 can detect a medium more quickly and stably by using a light detection sensor as the media sensor 116, compared to using a contact detection sensor.

The media sensor 116 may include a reflector such as a mirror instead of the light guide. The light emitter and the light receiver in the media sensor 116 may be located facing each other with the medium conveyance path in between.

The media sensor 116 may detect the presence of a medium by an ultrasonic sensor including an ultrasonic transmitter and an ultrasonic receiver that are located near the medium conveyance path to face each other with the medium conveyance path in between. The ultrasonic transmitter outputs (transmits) ultrasonic waves. The ultrasonic receiver receives ultrasonic waves that are output (transmitted) by the ultrasonic transmitter and passed through the medium, and then, generates and outputs a media signal corresponding to the received ultrasonic waves. In this case, the medium conveying apparatus 100 may detect a media multi-feed as well as the presence of a medium using the ultrasonic sensor. The medium conveying apparatus 100 can appropriately determine the timing to start feeding a medium by using the ultrasonic sensor as a detection unit without using a dedicated sensor for determining the timing to start feeding a medium.

The media sensor 116 may detect the presence of a medium by a contact detection sensor including an arm movable by contact with the medium and a light emitter and a light receiver facing each other with the arm in between. The medium conveying apparatus 100 can detect a medium with high accuracy without being affected by contamination (e.g., paper dust, roller abrasion powder, dust particles) around the light emitter or the light receiver by using the contact detection sensor as a detection unit.

The media sensor 116 may detect the presence of a medium by an encoder including a disk, a light emitter, and a light receiver. The disk has a large number of slits (light transmission holes) and rotates with the fed medium. The light emitter and the light receiver are located facing each other with the disk in between. The light emitter is, for example, an LED and emits light toward the disk (light receiver). The light receiver is, for example, a photodiode and receives light emitted by the light emitter through the disk. The light receiver generates a media signal indicating whether a change occurs within a predetermined period between the state where the slit is present between the light emitter and the light receiver and the state where the slit is absent and the light is blocked by the disk. The medium conveying apparatus 100 can detect a medium with high accuracy without being affected by contamination (e.g., paper dust, roller abrasion powder, dust particles) around the light emitter or the light receiver by using the contact detection sensor as a detection unit.

The imaging device 117 is located downstream from the first conveyance roller 114 and the second conveyance roller 115 and images a medium conveyed by the first conveyance roller 114 and the second conveyance roller 115. The imaging device 117 includes a first imaging device 117*a* and a second imaging device 117*b* that are located facing each other with the medium conveyance path in between.

The first imaging device 117*a* includes a line sensor (imaging sensor) based on a unity-magnification optical system type contact image sensor (CIS) including complementary metal oxide semiconductor (COMS-) based imaging elements linearly arranged in the main scanning direction. The first imaging device 117*a* further includes a lens that forms an image on an imaging element and an analog-to-digital (A/D) converter that amplifies the electrical signal output from the imaging element and performs A/D conversion. The first imaging device 117*a* images the front side of the conveyed medium under the control of a processing circuit described later. The first imaging device 117*a* sequentially generates and outputs line images each obtained by imaging an area of the conveyed medium facing the line sensor at regular intervals.

Similarly, the second imaging device 117*b* includes a line sensor (imaging sensor) based on a unity-magnification optical system type CIS including CMOS-based imaging elements linearly arranged in the main scanning direction. The second imaging device 117*b* further includes a lens that forms an image on an imaging element and an analog-to-digital (A/D) converter that amplifies the electrical signal output from the imaging element and performs A/D conversion. The second imaging device 117*b* images the back side of the conveyed medium under the control of a processing circuit described later. The second imaging device 117*b* sequentially generates and outputs line images each obtained by imaging an area of the conveyed medium facing the line sensor at regular intervals.

The medium conveying apparatus 100 may include either the first imaging device 117*a* or the second imaging device 117*b* and read only one side of the medium. Instead of the line sensor based on a unity-magnification CIS including CMOS-based imaging elements, a line sensor (imaging sensor) based on a unity-magnification CIS including charge-coupled device- (CCD-) based imaging elements may be used. Alternatively, a line sensor (imaging sensor) employing a reduction optical system and including CMOS-based or CCD-based imaging elements may be used.

The third conveyance roller 118 and the fourth conveyance roller 119 are located downstream from the imaging device 117 and face each other. The third conveyance roller 118 and the fourth conveyance roller 119 eject a medium conveyed by the first conveyance roller 114 and the second conveyance roller 115 and imaged by the imaging device 117 onto the ejection tray 104.

As the feed roller 112 rotates in the direction indicated by Arrow A3 of FIG. 2, that is, in the medium feeding direction, the medium is conveyed from the media tray 103 in the medium conveying direction A1 between the lower guide 101*a* and the upper guide 102*a*. The medium conveying apparatus 100 has two feeding modes: a separation mode in which media are fed while being separated and a non-separation mode in which media are fed without being separated. The feeding mode is set by a user using the operation device 105 or an information processing apparatus connected to the medium conveying apparatus 100 for communication. When the feeding mode is set to the separation mode, the separation roller 113 rotates in the direction indicated by Arrow A4, that is, in the direction opposite the medium feeding direction or stops rotating during media conveyance. This operation prevents the feeding of a medium other than the separated medium (prevention of multi-feed). By contrast, when the feeding mode is set to the non-separation mode, the separation roller 113 rotates in the medium feeding direction that is the direction opposite the one indicated by arrow A4.

The medium is fed between the first conveyance roller 114 and the second conveyance roller 115 while being guided by the lower guide 101*a* and the upper guide 102*a*. The medium is fed between the first imaging device 117*a* and the second imaging device 117*b* as the first conveyance roller 114 and the second conveyance roller 115 rotate in the directions indicated by Arrows A5 and A6, respectively. The medium read by the imaging device 117 is ejected onto the ejection tray 104 as the third conveyance roller 118 and the fourth conveyance roller 119 rotate in the directions indicated by Arrows A7 and A8, respectively.

Figure 3:
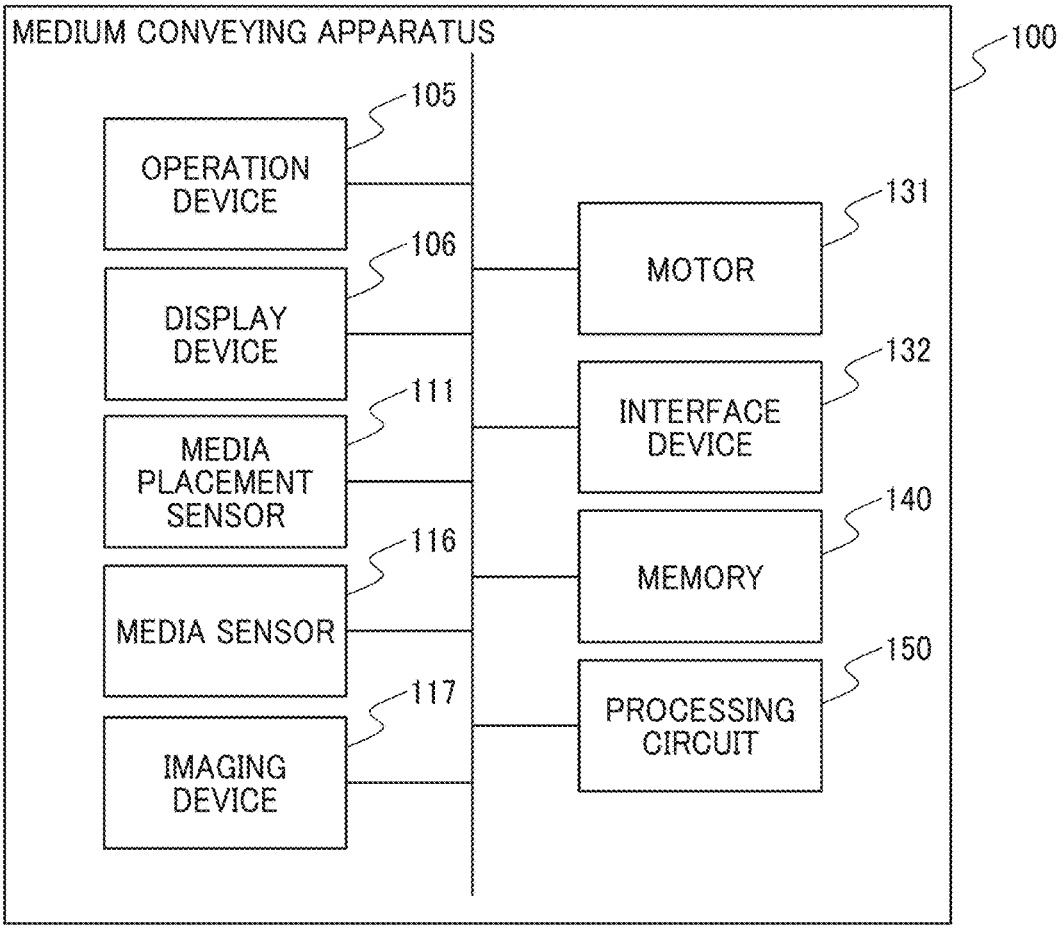
FIG. 3 is a schematic block diagram of a configuration of the medium conveying apparatus of FIG. 1.

FIG. 3 is a schematic block diagram of a configuration of the medium conveying apparatus 100.

The medium conveying apparatus 100 further includes a motor 131, an interface device 132, a memory 140, and a processing circuit 150 in addition to the above-described components.

The motor 131 includes one or more motors. The motor 131 rotates the feed roller 112, the separation roller 113, the first conveyance roller 114, the second conveyance roller 115, the third conveyance roller 118, and/or the fourth conveyance roller 119 to convey the medium in response to a control signal from the processing circuit 150. The motor 131 may include individual motors that independently rotate the feed roller 112, the separation roller 113, the first conveyance roller 114, the second conveyance roller 115, the third conveyance roller 118, and/or the fourth conveyance roller 119. One of the first conveyance roller 114 and the second conveyance roller 115 may be a driven roller that rotates by the rotation of the other one. One of the third conveyance roller 118 and the fourth conveyance roller 119 may be a driven roller that rotates by the rotation of the other one.

The interface device 132 includes an interface circuit compatible with a serial bus such as a universal serial bus (USB) and is electrically connected to an information processing apparatus (e.g., a personal computer or a mobile information processing terminal) to transmit and receive an input image and various kinds of information to and from the information processing apparatus. The interface device 132 may be substituted by a communication unit including an antenna to transmit and receive wireless signals and a wireless communication interface device to transmit and receive the signals through a wireless communication line according to a predetermined communication protocol. The predetermined communication protocol is, for example, a wireless local area network (LAN) communication protocol. The communication unit may include a wired communication interface device to transmit and receive signals through a wired communication line according to a communication protocol such as a wired LAN communication protocol.

The memory 140 includes a random-access memory (RAM), a read-only memory (ROM), a fixed disk device such as a hard disk, or a portable memory such as a flexible disk or an optical disc. The memory 140 stores, for example, computer programs, databases, and tables used for various processes performed by the medium conveying apparatus 100. The computer programs may be installed in the memory 140 from a computer-readable portable recording medium using a known setup program. Examples of the portable recording medium include a compact disc read-only memory (CD-ROM) and a digital versatile disc read-only memory (DVD-ROM). The computer programs may be distributed from a server and installed in the memory 140.

The processing circuit 150 operates according to a program pre-stored in the memory 140. The processing circuit 150 is, for example, a central processing unit (CPU). Alternatively, a digital signal processor (DSP), a large-scale integration (LSI), an application-specific integrated circuit (ASIC), or a field-programmable gate array (FPGA) may be used as the processing circuit 150.

The processing circuit 150 is connected to components including the operation device 105, the display device 106, the media placement sensor 111, the media sensor 116, the imaging device 117, the motor 131, the interface device 132, and the memory 140 and controls the components. The processing circuit 150 controls operations such as driving the motor 131 and imaging with the imaging device 117 based on the signals received from the sensors to acquire an input image from the imaging device 117. Then, the processing circuit 150 transmits the input image to the information processing apparatus via the interface device 132.

Figure 4:
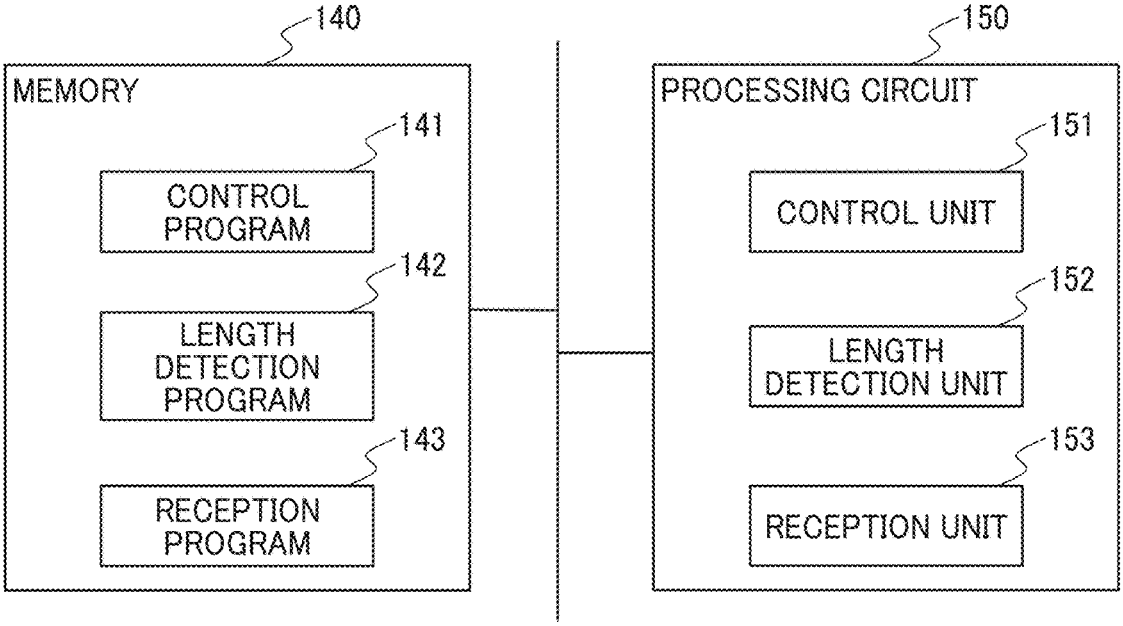
FIG. 4 is a schematic block diagram of a configuration of a memory and a processing circuit according to an embodiment.

FIG. 4 is a schematic block diagram of a configuration of the memory 140 and the processing circuit 150.

As illustrated in FIG. 4, the memory 140 stores a control program 141, a length detection program 142, and a reception program 143. These programs are functional modules implemented by software operating on a processor. The processing circuit 150 reads the programs from the memory 140 and operates according to the read programs. Thus, the processing circuit 150 functions as a control unit 151, a length detection unit 152, and a reception unit 153.

Figure 5:
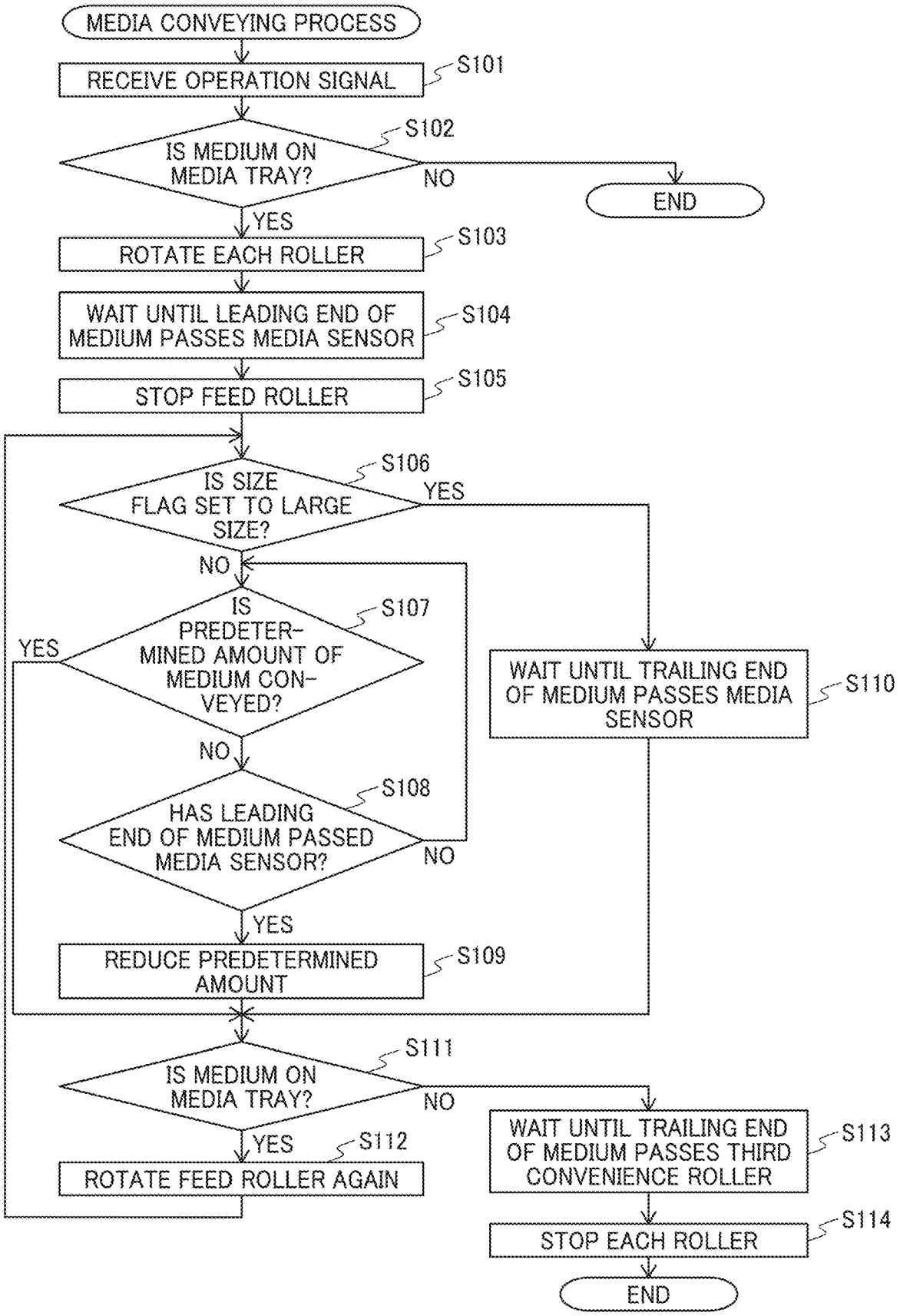
FIG. 5 is a flowchart of a media conveying process according to an embodiment.

FIG. 5 is a flowchart of a media conveying process performed by the medium conveying apparatus 100.

An example of a media conveying process performed by the medium conveying apparatus 100 is described below with reference to the flowchart of FIG. 5. The process described below is executed, for example, by the processing circuit 150 in cooperation with the components of the medium conveying apparatus 100 according to the program pre-stored in the memory 140.

The control unit 151 waits until the control unit 151 receives an operation signal instructing the reading of media from the operation device 105 or the interface device 132 (Step S101). The operation signal is output when the user inputs an instruction to read media using the operation device 105 or the information processing apparatus.

Subsequently, the control unit 151 acquires a placement signal from the media placement sensor 111 and determines whether a medium is placed on the media tray 103 based on the acquired placement signal (Step S102). When no media is present on the media tray 103, the control unit 151 ends the series of steps.

On the other hand, when a medium is present on the media tray 103, the control unit 151 drives the motor 131 to rotate the feed roller 112, the separation roller 113, the first conveyance roller 114, the second conveyance roller 115, the third conveyance roller 118, and/or the fourth conveyance roller 119 to feed and convey the medium (Step S103).

Subsequently, the control unit 151 waits until the leading end of the medium passes the media sensor 116 (Step S104). The control unit 151 periodically acquires the media signal from the media sensor 116 and determines that the leading end of the medium has passed the media sensor 116 when the signal value of the media signal changes from a value indicating the absence of a medium to a value indicating the presence of a medium.

When the leading end of the medium has passed the media sensor 116, the control unit 151 determines that the leading end of the medium has passed the position of the first conveyance roller 114 and the second conveyance roller 115 and controls the motor 131 to stop the feed roller 112 (Step S105). Then, the medium is conveyed by the first conveyance roller 114, the second conveyance roller 115, the third conveyance roller 118, and/or the fourth conveyance roller 119. By stopping the feed roller 112, the medium conveying apparatus 100 can prevent media jams caused by the medium being pushed and bent by the feed roller 112, as well as media multi-feeds caused by the next medium being fed by the feed roller 112. In the description, "next medium" refers to a medium that is fed immediately after a previously fed and conveyed medium.

Subsequently, the control unit 151 determines whether the size flag is set to "large size" or "non-large size" (Step S106). The size flag is set to "non-large size" at the start of the media conveying process. In a process described later, the size flag is set to "large size" when the length of a fed medium is determined to be greater than a threshold and is set to "non-large size" when the length of a fed medium is determined to be equal to or less than the threshold. For example, the threshold is set to the media size estimated to be most frequently conveyed in the medium conveying apparatus 100, such as A4. That is, the size flag is set to "large size" when the media size is greater than the size estimated to be most frequently conveyed in the medium conveying apparatus 100, such as A4. The size flag may be set by comparing a sheet length detected by a known device such as a sheet length sensor to detect the sheet length of a sheet placed on the media tray 103 with the threshold. The size flag may be set based on user input specifying the sheet type using the operation device 105 or the information processing apparatus.

When the size flag is set to "non-large size", the control unit 151 determines whether a predetermined amount of the medium has been conveyed after the leading end of the medium passed the media sensor 116 (Step S107). For example, the predetermined amount is set to the motor drive amount to drive the feed roller 112 to move a medium by a first distance. The predetermined amount may be set to a rotation amount of the feed roller 112 to move a medium by the first distance. The predetermined amount may be set to the motor drive time to drive the feed roller 112 to move a medium by the first distance. The control unit 151 determines that the medium has been conveyed by the predetermined amount when the motor is driven by an amount corresponding to the predetermined amount of conveyance of the medium after determining that the leading end of the medium has passed the media sensor 116 in Step S104.

Figure 6A:
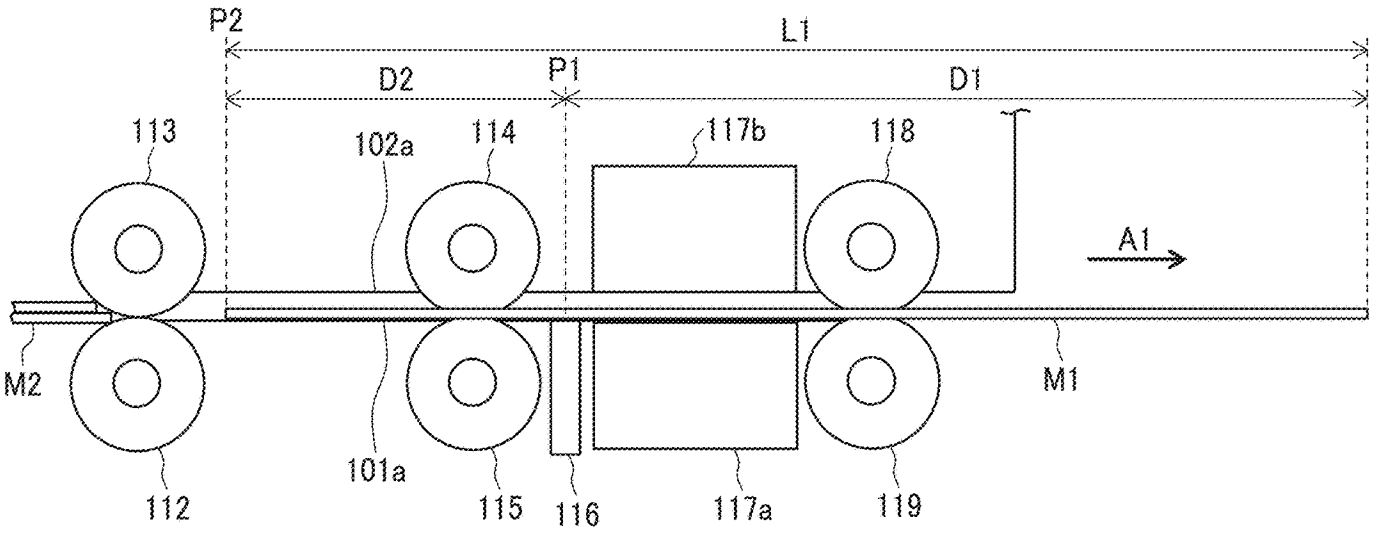
FIG. 6A is a schematic diagram for explaining a first distance according to an embodiment.

FIG. 6A is a schematic diagram for explaining a first distance.

As illustrated in FIG. 6A, a first distance D1 is obtained by subtracting a second distance D2 from a length L1 of a medium M1 having a specific size in the medium conveying direction A1. The second distance D2 is the distance from a position P1 of the media sensor 116 to a specific position P2. The specific position P2 is between a pair of the feed roller 112 and the separation roller 113 and the pair of the first conveyance roller 114 and the second conveyance roller 115. For example, the media size estimated to be most frequently conveyed in the medium conveying apparatus 100, such as A4 portrait, is set as the specific size. That is, when the medium M1 is moved by the first distance D1 after the leading end of the medium M1 passes the media sensor 116, the trailing end of the medium M1 passes the feed roller 112 and the separation roller 113 (separator).

When the medium is conveyed by the predetermined amount after the leading end of the medium passes the media sensor 116, the control unit 151 starts feeding the next medium in a process described later. Accordingly, the medium conveying apparatus 100 can prevent a media multi-feed caused by starting to feed a next medium M2 before the trailing end of the fed medium M1 passes the feed roller 112 and the separation roller 113 (separator). Further, the medium conveying apparatus 100 can start feeding the next medium M2 without waiting for the trailing end of the medium M1 to pass the media sensor 116. This results in multiple media being fed in a short time.

When determining that the medium has been conveyed by the predetermined amount after the leading end of the medium passed the media sensor 116, the control unit 151 proceeds to Step S111.

On the other hand, when determining that the medium has not been conveyed by the predetermined amount after the leading end of the medium passed the media sensor 116, the control unit 151 determines whether the trailing end of the medium has passed the media sensor 116 (Step S108). The control unit 151 periodically acquires the media signal from the media sensor 116 and determines that the trailing end of the medium has passed the media sensor 116 when the signal value of the media signal changes from a value indicating the presence of a medium to a value indicating the absence of a medium.

Figure 6B:
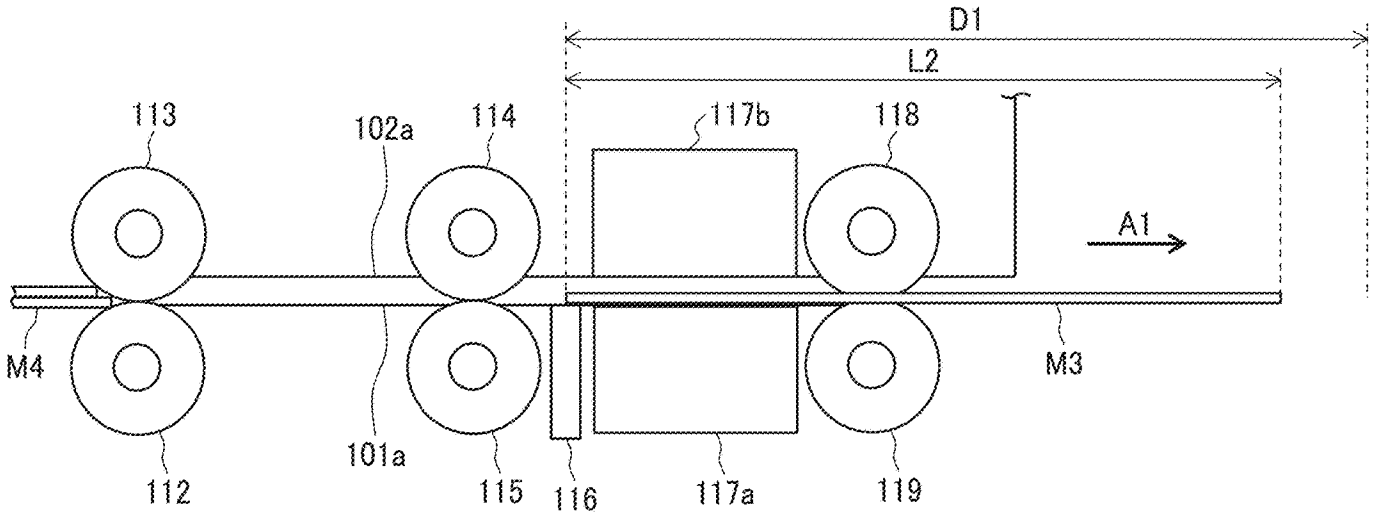
FIG. 6B is a schematic diagram for explaining a situation where the trailing end of a medium passes a media sensor according to an embodiment.

FIG. 6B is a schematic diagram for explaining a situation where the trailing end of a medium passes the media sensor 116 before the medium is conveyed by the predetermined amount after the leading end of the medium passes the media sensor 116.

As illustrated in FIG. 6B, when the trailing end of a medium M3 passes the media sensor 116 before the medium M3 is moved by the first distance D1 after the leading end of the medium M3 passes the media sensor 116, a length L2 of the medium M3 is estimated to be shorter than the first distance D1.

When the trailing end of a medium passes the media sensor 116 before the medium is conveyed by the predetermined amount after the leading end of the medium passes the media sensor 116, the control unit 151 starts feeding the next medium in a process described later. Accordingly, the medium conveying apparatus 100 can start feeding a next medium M4 before the medium M3 having a small size (small-sized medium M3) is conveyed by the predetermined amount. This results in multiple small-sized media being fed in a short time while preventing media multi-feeds.

When determining that the trailing end of the medium has not passed the media sensor 116, the control unit 151 returns to Step S107 and repeats Step S107.

On the other hand, when determining that the trailing end of the medium has passed the media sensor 116, the control unit 151 reduces the predetermined amount (Step S109) and proceeds to Step S111. The control unit 151 reduces the predetermined amount to an amount to move the small-sized medium by a third distance (the motor drive amount, the rotation amount of the feed roller 112, or the rotation time of the feed roller 112).

The third distance is obtained by subtracting the second distance D2 from the length L2 of the small-size medium M3 in the medium conveying direction A1. The length L2 is set to the medium movement (conveyance) distance from when the leading end of the medium passes the media sensor 116 to when the trailing end of the medium passes the media sensor 116. The length L2 may be set to a predetermined length. In this case, a size less than the size estimated to be most frequently conveyed in the medium conveying apparatus 100, such as A5 portrait is set as the length L2.

When the small-seized medium M3 is moved by the third distance after the leading end of the medium M3 passes the media sensor 116, the trailing end of the medium M3 passes the position of the feed roller 112 and the separation roller 113 (separator). The types of media collectively placed on the media tray 103 by the user and fed are highly likely to be the same. When the medium currently being fed (current medium) is a small-sized medium, the next medium fed (next medium) is likely to be a small-sized medium as well. When the medium currently being fed is a small-sized medium, the control unit 151 reduces the predetermined amount to be used for the next medium fed to an amount corresponding to the small-sized medium. Accordingly, the medium conveying apparatus 100 can start feeding the next medium before the trailing end of the small-sized medium passes the media sensor 116. This results in multiple small-sized media being fed in a shorter time while preventing media multi-feeds.

When multiple media are continuously fed, the control unit 151 may reduce the predetermined amount when a predetermined number of media consecutively satisfy the condition that the trailing end of a medium passes the media sensor 116 before the medium is conveyed by the predetermined amount after the leading end of the medium passes the media sensor 116. In this case, the control unit 151 does not reduce the predetermined amount even when a single medium satisfies the condition that the trailing end of a medium passes the media sensor 116 before the medium is conveyed by the predetermined amount after the leading end of the medium passes the media sensor 116. This allows the medium conveying apparatus 100 to prevent erroneously reducing the predetermined amount when the size of the medium is not small. This also allows the medium conveying apparatus 100 to prevent erroneously reducing the predetermined amount to suit smaller media when different sizes of media are mixed and placed on the media tray 103 to be conveyed.

On the other hand, when the size flag is set to "large size" in Step S106, the control unit 151 waits until the trailing end of the medium passes the media sensor 116 (Step S110). The control unit 151 determines whether the trailing end of the medium has passed the media sensor 116 in substantially the same manner as the processing of Step S108. When the trailing end of the medium has passed the media sensor 116, the control unit 151 proceeds to Step S111.

Figure 7:
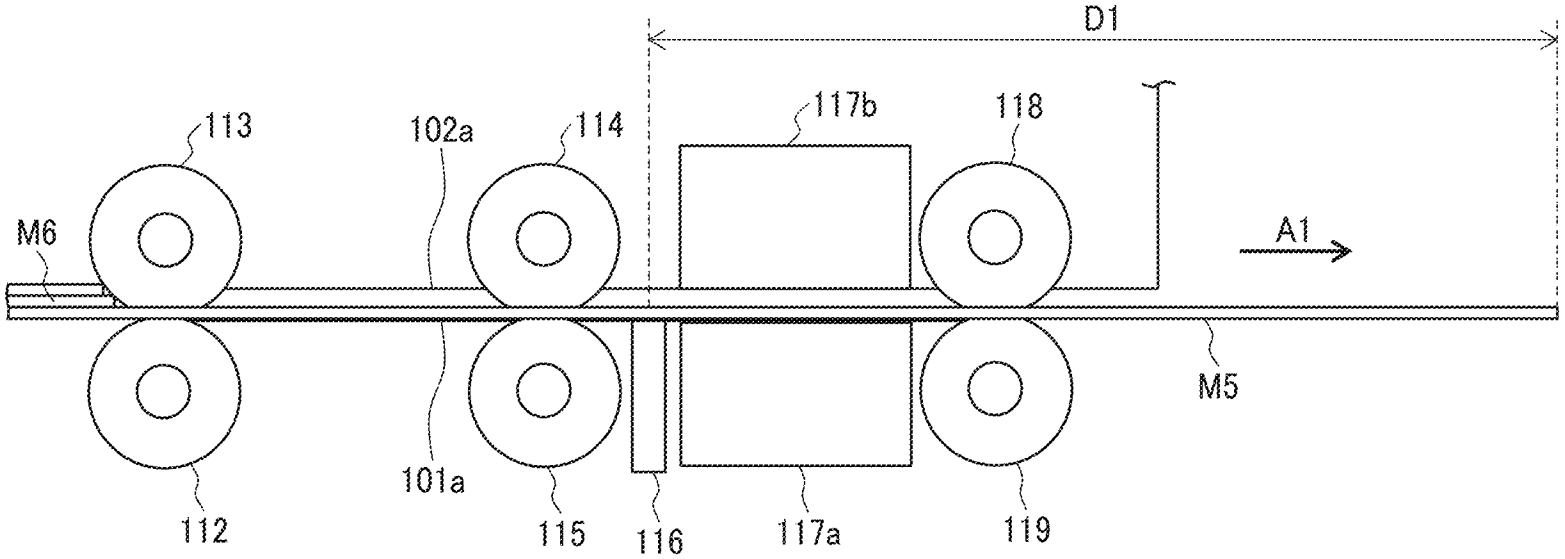
FIG. 7 is a schematic diagram for explaining a large-sized medium according to an embodiment.

FIG. 7 is a schematic diagram for explaining a large-sized medium.

As illustrated in FIG. 7, when a medium M5 that is a large-sized medium is moved by the first distance D1 after the leading end of the medium M5 passes the media sensor 116, the trailing end of the medium M5 may not pass the feed roller 112 and the separation roller 113 (separator). Even when the feeding of a next medium M6 is started in this situation, the medium M6 is separated from the medium M5 by the action of the separation roller 113 and is not fed downstream from the feed roller 112 and the separation roller 113 (separator). However, when the friction force between the separation roller 113 and the medium M6 is reduced due to the deterioration of the surfaces of the separation roller 113, the medium M6 may be fed downstream from the feed roller 112 and the separation roller 113 (separator), and a media multi-feed may occur. When a large-sized medium is fed, the medium conveying apparatus 100 does not start feeding the next medium until the trailing end of the medium passes the media sensor 116. This can reliably prevent a media multi-feed.

Referring back to FIG. 5, the control unit 151 acquires a placement signal from the media placement sensor 111 and determines whether a medium remains on the media tray 103 based on the acquired placement signal (Step S111).

When a medium remains on the media tray 103, the control unit 151 drives the motor 131 again to rotate the feed roller 112 to feed the next medium (Step S112). Then, the control unit 151 returns to Step S106 and repeats the processing from Step S106 onward.

As described above, when a medium is conveyed by the predetermined amount after the leading end of the medium passes the media sensor 116, the control unit 151 starts feeding the next medium. Accordingly, the medium conveying apparatus 100 can feed multiple media in a short time while preventing media multi-feeds.

Further, when the trailing end of a medium passes the media sensor 116 before the medium is conveyed by the predetermined amount after the leading end of the medium passes the media sensor 116, the control unit 151 starts feeding the next medium. Accordingly, the medium conveying apparatus 100 can feed multiple small-sized media in a short time while preventing media multi-feeds.

When a large-sized medium is fed and the trailing end of the medium passes the media sensor 116, the control unit 151 starts feeding the next medium. Accordingly, the medium conveying apparatus 100 can prevent a media multi-feed.

By contrast, when no medium remains on the media tray 103 in Step S111, the control unit 151 waits until the trailing end of the medium passes the third conveyance roller 118 and the fourth conveyance roller 119 (Step S113). The control unit 151 determines whether the trailing end of the medium has passed the media sensor 116 in substantially the same manner as the processing of Step S108. The control unit 151 determines that the trailing end of the medium has passed the third conveyance roller 118 and the fourth conveyance roller 119 when a first period has elapsed since the trailing end of the medium passed the media sensor 116. The first period is set to the time for the medium to be moved the distance between the media sensor 116 and the pair of the third conveyance roller 118 and the fourth conveyance roller 119.

The control unit 151 stops the motor 131 to stop the separation roller 113, the first conveyance roller 114, the second conveyance roller 115, the third conveyance roller 118, and/or the fourth conveyance roller 119 (Step S114) and ends the series of steps.

The processing of Steps S108 and S109 may be omitted, and the control unit 151 may not start feeding the next medium until the currently being fed medium (current medium) is conveyed by the predetermined amount after the leading end of the current medium passes the media sensor 116 regardless of whether the trailing end of the current medium has passed the media sensor 116.

Further, the processing of Step S109 may be omitted, and the control unit 151 may not change the predetermined amount even when the trailing end of the medium passes the media sensor 116 before the medium is conveyed by the predetermined amount after the leading end of the medium passes the media sensor 116.

Further, the processing of Steps S106 and S110 may be omitted, and the control unit 151 may start feeding the next medium when the current medium is conveyed by the predetermined amount after the leading end of the current medium passes the media sensor 116 even when the media are large size. In this case, the control unit 151 may change the predetermined amount according to the length of the medium detected by a known device such as a sheet length sensor to detect the sheet length of a sheet placed on the media tray 103. Alternatively, the control unit 151 may change the predetermined amount according to the length of the medium set based on user input specifying the sheet type using the operation device 105 or the information processing apparatus. Alternatively, the control unit 151 may change the predetermined amount according to the length detected in Step S204 for the medium fed immediately before. Alternatively, the control unit 151 may change the predetermined amount according to statistical values (mean, median, maximum, or minimum, etc.) of the length detected in Step S204 for a predetermined number of two or more media fed immediately before.

In Step S207, the control unit 151 may set the size flag to "large size" when each of the lengths of a predetermined number of two or more media continuously fed and detected by the length detection unit 152 is greater than the threshold.

Figure 8:
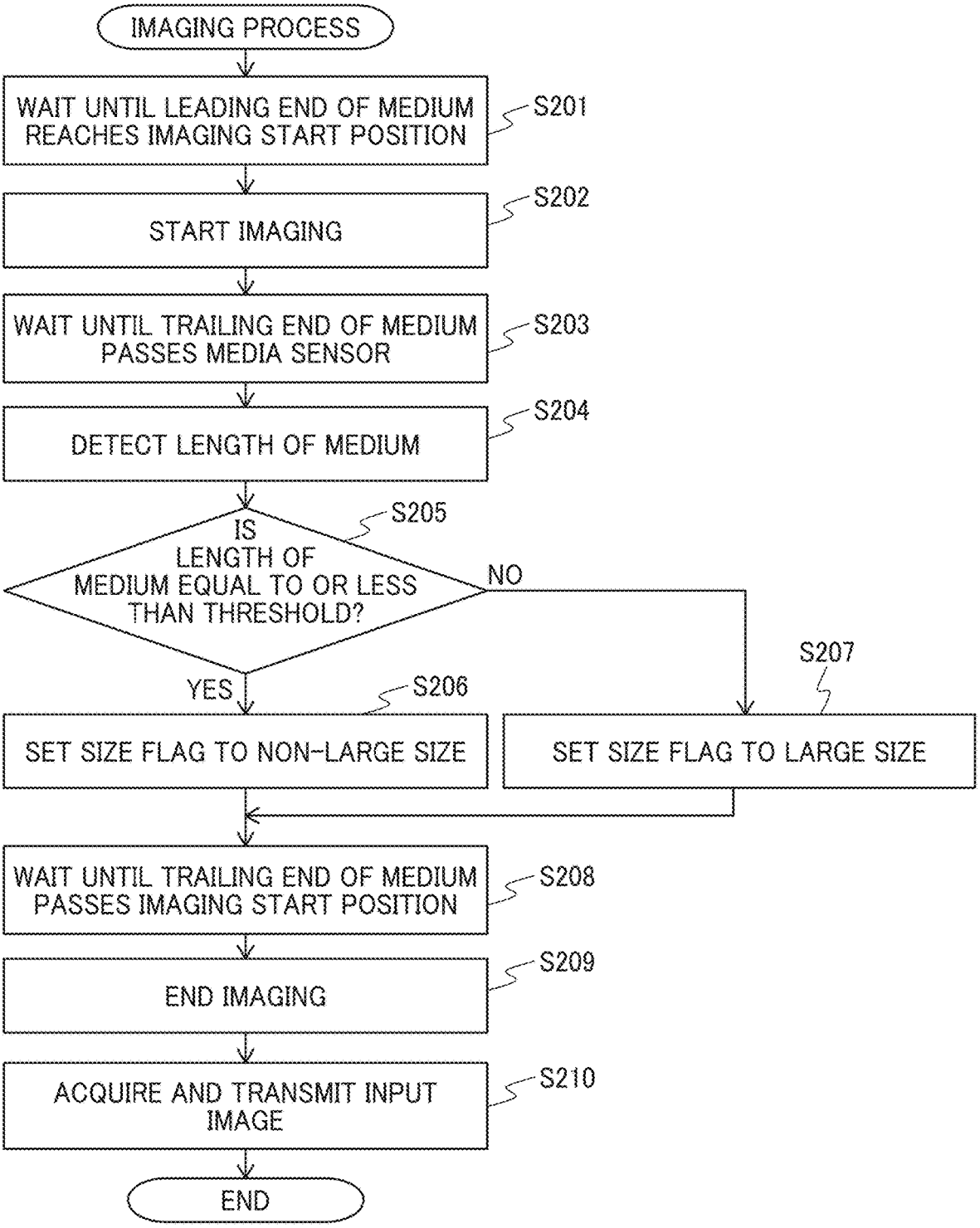
FIG. 8 is a flowchart of an imaging process according to an embodiment.

FIG. 8 is a flowchart of an example of an imaging process performed by the medium conveying apparatus 100.

An example of the imaging process performed by the medium conveying apparatus 100 is described below with reference to the flowchart of FIG. 8. The process described below is executed, for example, by the processing circuit 150 in cooperation with the components of the medium conveying apparatus 100 according to the program pre-stored in the memory 140. The imaging process is executed in parallel with the medium conveying process each time a medium is newly fed in the medium conveying process of FIG. 5.

The control unit 151 waits until the leading end of the medium reaches the imaging start position (Step S201). For example, the control unit 151 determines whether the leading end of the medium has passed the media sensor 116 in substantially the same manner as the processing of Step S104 in FIG. 5 and determines that the leading end of the medium has reached the imaging start position when the leading end of the medium has passed the media sensor 116. The control unit 151 may determine that the leading end of the medium has reached the imaging start position when a predetermined time has passed since starting to feed the medium. Alternatively, the control unit 151 may determine that the leading end of the medium has reached the imaging start position when a predetermined amount of the medium is conveyed after the leading end of the medium passes the media sensor 116.

Subsequently, the control unit 151 causes the imaging device 117 to start imaging the medium (Step S202). After that, the control unit 151 acquires the line images output from the imaging device 117 and stores the line images in the memory 140 each time the imaging device 117 outputs a line image.

Subsequently, the length detection unit 152 waits until the trailing end of the medium passes the media sensor 116 (Step S203). The length detection unit 152 determines whether the trailing end of the medium has passed the media sensor 116 in substantially the same manner as the processing of Step S108 in FIG. 5.

The length detection unit 152 detects the length of the medium (Step S204). The length detection unit 152 calculates the elapsed time from when the leading end of the medium is determined to have passed the media sensor 116 in Step S104 of FIG. 5 until the trailing end of the medium passes the media sensor 116. The length detection unit 152 obtains the detected length of the medium by multiplying the calculated elapsed time by the medium conveying speed. The length detection unit 152 may detect the length of the medium based on the motor drive amount that is to drive the feed roller 112, during the calculated elapsed time. In this case, the medium conveying apparatus 100 pre-stores a relationship equation between the motor drive amount and the medium movement distance in the memory 140, and the length detection unit 152 obtains the movement distance of the medium corresponding to the motor drive amount as the length of the medium using the relationship equation.

Subsequently, the control unit 151 determines whether the length of the medium detected by the length detection unit 152 is equal to or less than the threshold (Step S205). For example, the threshold is set to a size obtained by adding the distance from the specific position P2 to the pair of the feed roller 112 and the separation roller 113 (separator) to the specific size (e.g., longitudinal dimension of A4). The threshold may be set to a size obtained by adding a margin (e.g., 10 mm) to the distance from the specific position P2 to the pair of the paper feed roller 112 and the separation roller 113 (separation unit) plus the specific size (e.g., longitudinal dimension of A4).

When the length of the medium detected by the length detection unit 152 is equal to or less than the threshold, the control unit 151 sets the size flag to "non-large size" (Step S206). In this case, in the media conveying process of FIG. 5, when the next medium is fed, it is determined in Step S106 that the size flag is set to "non-large size," and the process moves to Step S107.

On the other hand, when the length of the medium detected by the length detection unit 152 is greater than the threshold, the control unit 151 sets the size flag to "large size" (Step S207). In this case, in the media conveying process of FIG. 5, when the next medium is fed, it is determined in Step S106 that the size flag is set to "large size," and the processing of Step S110 is executed. That is, when the length of the medium detected by the length detection unit 152 is greater than the threshold and the trailing end of the next medium passes the media sensor 116, the control unit 151 starts feeding the subsequent medium that is the one to be fed immediately after the next medium.

Accordingly, the control unit 151 can prevent starting to feed the next medium before the trailing end of the current medium passes the feeding roller 112 and the separation roller 113 (separator) and can prevent a media multi-feed. In the description, "subsequent medium" refers to a medium that is fed immediately after the next medium.

Subsequently, the control unit 151 waits until the trailing end of the medium passes the imaging position of the imaging device 117 (Step S208). The control unit 151 determines whether the trailing end of the medium has passed the media sensor 116 in substantially the same manner as the processing of Step S108 in FIG. 5. The control unit 151 determines that the trailing end of the medium has passed the imaging position of the imaging device 117 when a second period has elapsed since the trailing end of the medium passed the media sensor 116. The second period is set to the time for the medium to be moved the distance between the media sensor 116 and the imaging position of the imaging device 117.

Subsequently, the control unit 151 causes the imaging device 117 to end imaging (Step S209).

Then, the control unit 151 generates an input image by combining the line images output from the imaging device 117 and stored in the memory 140. The control unit 151 outputs the generated input image by transmitting the input image to the information processing apparatus via the interface device 132 (Step S210) and ends the series of steps.

The imaging device 117 may be used as a detection unit instead of the media sensor 116, and the control unit 151 may determine the timing to start feeding the medium based on the line images instead of the media signal. In this case, the media sensor 116 may be omitted from the medium conveying apparatus 100.

In this case, in Step S201 of FIG. 8, the control unit 151 determines that the leading end of the medium has reached the imaging start position when a third period has elapsed since the start of the feeding of the medium. The third period is set to the time for the leading end of the medium to pass the nip portion of the feeding roller 112 and the separation roller 113 (separator). The third period may be set to 0, and the control unit 151 may determine that the leading end of the medium has reached the imaging start position when starting to feed the medium.

In Step S104 of FIG. 5, the control unit 151 waits until the leading end of the medium passes (the imaging position of) the imaging device 117. The control unit 151 sequentially acquires the line images from the media sensor 116 and detects the leading end of the medium using a known image processing technique. For example, the control unit 151 extracts an edge pixel that has a gradation value (e.g., luminance value or color values) differing from that of the adjacent pixels by a tone threshold or greater in each line image. When an edge pixel is extracted for the first period in one of the sequentially acquired line images, the control unit 151 determines that the leading end of the medium has passed the imaging device 117. In Step S107 of FIG. 5, the second distance is set to the distance from the imaging position of the imaging device 117 to the specific position P2.

In Step S108 of FIG. 5, the control unit 151 determines whether the trailing end of the medium has passed (the imaging position of) the imaging device 117. The control unit 151 sequentially acquires the line images from the imaging device 117 and detects the trailing end of the medium using a known image processing technique. For example, the control unit 151 extracts an edge pixel in each line image in substantially the same manner as the processing of Step S104. The control unit 151 determines that the trailing end of the medium has passed the imaging device 117 when an edge pixel is extracted from one of the line images and no edge pixel is extracted from the subsequently acquired line images. Similarly, in Step S110 of FIG. 5, the control unit 151 determines whether the trailing end of the medium has passed the imaging device 117, thus, the control unit 151 waits until the trailing end of the medium passes the imaging device 117.

In Step S113 of FIG. 5, the control unit 151 determines that the trailing end of the medium has passed the third conveyance roller 118 and the fourth conveyance roller 119 when a fourth period has elapsed since the trailing end of the medium passed the imaging device 117. The fourth period is set to the time for the medium to be moved the distance between (the imaging position of) the imaging device 117 and the pair of the third conveyance roller 118 and the fourth conveyance roller 119.

In Step S203 of FIG. 8, the length detection unit 152 determines whether the trailing end of the medium has passed the imaging device 117, thus, the control unit 151 waits until the trailing end of the medium passes the imaging device 117. In Step S204, the length detection unit 152 obtains the detected length of the medium by multiplying the elapsed time from when the leading end of the medium passes the imaging device 117 to when the trailing end of the media passes the imaging device 117 by the medium conveying speed. The length detection unit 152 may detect the length of the medium based on the motor drive amount that is to drive the feed roller 112 during the elapsed time. The length detection unit 152 may detect the leading end and the trailing end of the medium from the line images using a known image processing technique. The length detection unit 152 may also detect the length of the medium based on the number of lines and the resolution between the line images from which the leading end and the trailing end of the medium are detected. Since the processing of Step S203 is waiting until the trailing end of the medium passes the imaging device 117, the processing of Step S208 is omitted.

The number of the media sensors 116 is not limited to one and may be plural. For example, the medium conveying apparatus 100 may include multiple media sensors 116 aligned and spaced apart in the width direction A2 and may detect skew of a medium using the media sensors 116. In this case, the control unit 151 determines whether the leading end of the medium has passed each media sensor 116 based on the media signal acquired from each media sensor 116 and stores the time at which the leading end of the medium passed each media sensor 116 in the memory 140. The control unit 151 calculates the tilt of the medium based on the difference in time when the leading end of the medium passes each media sensor 116, the medium conveying speed, and the distance between the media sensors 116. The control unit 151 determines the occurrence of the skew of a medium when the calculated tilt of the medium is greater than a pre-set tilt threshold.

The control unit 151 may change the timing to start feeding the next medium according to the tilt of the medium. For example, the control unit 151 delays the timing to start feeding the next medium when the skew of the medium has occurred, compared to the timing to start feeding the next medium when the skew of the medium has not occurred. Accordingly, the medium conveying apparatus 100 can prevent media jams caused by the collision between the leading end of the newly fed medium and the trailing end of the previously fed medium when the previously fed medium is tilted. Further, the control unit 151 may delay the timing to start feeding the next medium as the tilt of the medium increases. Accordingly, the medium conveying apparatus 100 can more effectively prevent media jams caused by the collision between the leading end of the newly fed medium and the trailing end of the previously fed medium when the previously fed medium is tilted.

The predetermined amount for comparison with the amount of conveyance of the fed medium and/or the threshold for comparison with the length of the fed medium may be set by the user. In this case, in Step S101 of FIG. 5, the reception unit 153 receives the setting of the predetermined amount and/or the threshold according to a user operation. For example, the reception unit 153 receives a profile set by the user using the information processing apparatus before the user inputs an instruction to read media, along with an operation signal instructing to read media. The profile is setting information for defining an operation for the medium conveying apparatus 100 to convey and/or image a medium. The profile includes the predetermined amount and/or the image resolution, the colors, as well as the predetermined amount and/or the threshold. The reception unit 153 may receive the predetermined amount and/or the threshold specified by the user using the operation device 105 from the operation device 105. Accordingly, the medium conveying apparatus 100 can set a parameter for determining the timing to start feeding a medium for each user according to the type of media to be read, the use of an image obtained by imaging a medium, etc.

The reception unit 153 may receive a setting for media size (standard size such as A5 portrait or A4 portrait) or media length instead of the predetermined amount. In this case, the reception unit 153 calculates the first distances D1 based on the set media size or media length and calculates the predetermined amount from the calculated first distances D1.

As described above, the medium conveying apparatus 100 starts feeding the next medium when the medium is conveyed by the predetermined amount after the leading end of the medium passes the media sensor 116 located downstream from the first conveyance roller 114 and the second conveyance roller 115. Accordingly, the medium conveying apparatus 100 can start feeding the next medium with appropriate timing and feed each medium with more appropriate timing while preventing a media multi-feed.

In particular, the medium conveying apparatus 100 determines the timing to start feeding a medium using the media sensor 116 that is used to identify the imaging timing of the imaging device 117 or using the imaging device 117. Thus, the medium conveying apparatus 100 can appropriately determine the timing to start feeding a medium without using a dedicated sensor for determining the timing to start feeding a medium. As a result, the medium conveying apparatus 100 can increase the processing performance of the media conveying process while preventing an increase in the apparatus cost and the power consumption.

Further, the medium conveying apparatus 100 can increase the processing performance of the media conveying process by shortening the interval between the media to be fed without increasing the medium conveying speed (speeding up the media conveyance). As a result, the medium conveying apparatus 100 can increase the processing performance of the media conveying process while preventing an increase in power consumption due to the motor 131.

Figure 9:
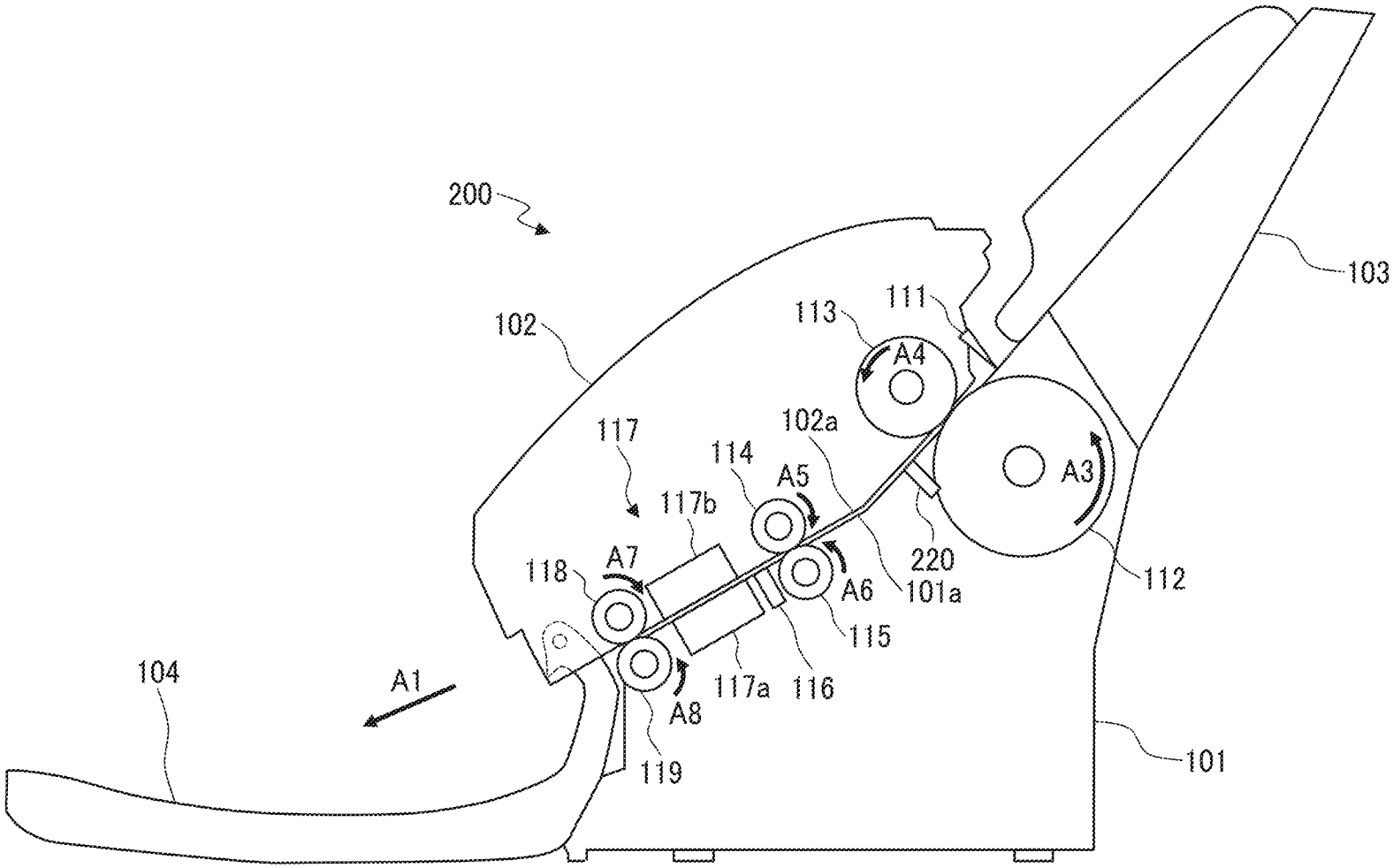
FIG. 9 is a diagram for explaining a conveyance path inside a medium conveying apparatus according to another embodiment.

FIG. 9 is a diagram for explaining a media conveyance path inside a medium conveying apparatus according to another embodiment.

A medium conveying apparatus 200 illustrated in FIG. 9 has substantially the same configuration and functions as the medium conveying apparatus 100. The medium conveying apparatus 200 further includes a second media sensor 220 in addition to the components included in the medium conveying apparatus 100.

The second media sensor 220 is an example of a second detection unit and detects a medium conveyed to the second media sensor 220. The second media sensor 220 is located between the pair of the feed roller 112 and the separation roller 113 (separator) and the pair of the first conveyance roller 114 and the second conveyance roller 115 in the medium conveying direction A1.

The second media sensor 220 includes a light emitter, a light receiver, and a light guide. The light emitter and the light receiver are located on one side of the medium conveyance path. The light guide faces the light emitter and the light receiver across the medium conveyance path. The light emitter is, for example, an LED and emits light toward the medium conveyance path. The light receiver is, for example, a photodiode and detects (receives) the light emitted by the light emitter and guided by the light guide. When a medium is present at a position facing at least one of the light emitter and the light receiver, the light emitted from the light emitter is blocked by the medium, and the light receiver does not detect the light emitted from the light emitter. The second media sensor 220 generates and outputs a second media signal whose signal value changes depending on whether a medium is present at the position of the second media sensor 220, based on the intensity of light received by the light receiver.

As described above, the second media sensor 220 is a light detection sensor that emits light toward the medium conveyance path and detects the received light. The second media sensor 220 may include a reflector such as a mirror instead of the light guide. The light emitter and the light receiver in the second media sensor 220 may be located facing each other with the medium conveyance path in between. The second media sensor 220 may detect the presence of a medium using, for example, an ultrasonic sensor, a contact detection sensor, or an encoder.

When the medium conveying apparatus 200 executes the media conveying process of FIG. 5, the control unit 151 determines whether the trailing end of the medium has passed the second media sensor 220 in Step S108. The control unit 151 periodically acquires the second media signal from the second media sensor 220 and determines that the trailing end of the medium has passed the second media sensor 220 when the signal value of the second media signal changes from a value indicating that the presence of a medium to a value indicating the absence of a medium.

Figure 10:
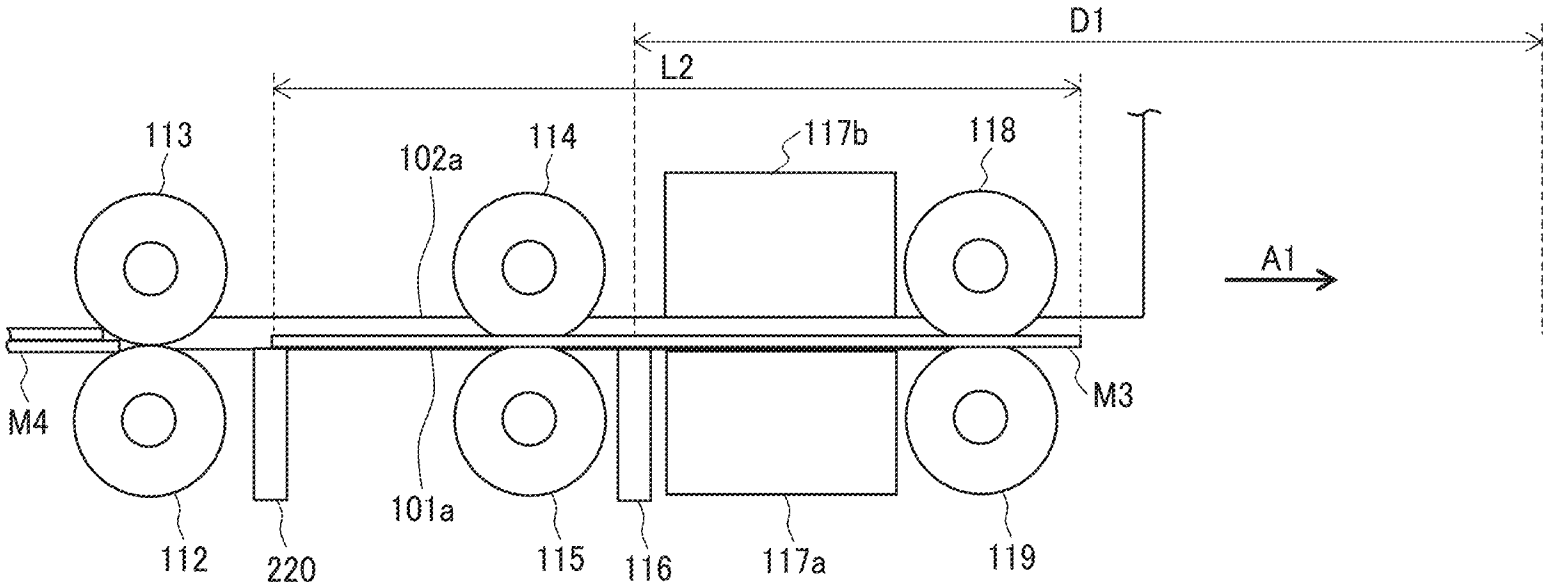
FIG. 10 is a schematic diagram for explaining a situation where the trailing end of a medium passes a second media sensor according to an embodiment.

FIG. 10 is a schematic diagram for explaining a situation where the trailing end of a medium passes the second media sensor 220 before the medium is conveyed by the predetermined amount after the leading end of the medium passes the media sensor 116.

As illustrated in FIG. 10, the second media sensor 220 is located downstream from the feed roller 112 and the separation roller 113 (separator) and upstream from the media sensor 116 in the medium conveying direction A1. With this configuration, when the trailing end of the small-sized medium M3 passes the second media sensor 220, the trailing end of the medium M3 has already passed the feed roller 112 and separation roller 113 (separator). Further, the trailing end of the small-sized medium M3 passes the second media sensor 220 before passing the media sensor 116.

When the trailing end of a medium passes the second media sensor 220 before the medium is conveyed by the predetermined amount after the leading end of the medium passes the media sensor 116, the control unit 151 starts feeding the next medium in Step S112. Accordingly, the medium conveying apparatus 200 can start feeding the next medium M4 before the trailing end of the small-sized medium M3 passes the media sensor 116. This results in multiple small-sized media being fed in a shorter time while preventing media multi-feeds.

When the medium conveying apparatus 200 executes the media conveying process of FIG. 5, the control unit 151 waits until the trailing end of the medium passes the second media sensor 220 in Step S110. The control unit 151 determines whether the trailing end of the medium has passed the second media sensor 220 in substantially the same manner as the processing of Step S108.

That is, when the length of the medium detected by the length detection unit 152 is greater than the threshold and the trailing end of the next medium passes the second media sensor 220, the control unit 151 starts feeding the subsequent medium. When a large-sized medium is fed, the medium conveying apparatus 200 does not start feeding the next medium until the trailing end of the medium passes the second media sensor 220. This can reliably prevent a media multi-feed. Further, the medium conveying apparatus 200 can start feeding the next medium M4 before the trailing end of the large-sized medium passes the media sensor 116. This results in multiple large-sized media being fed in a shorter time.

When the imaging process of FIG. 8 is executed by the medium conveying apparatus 200, the length detection unit 152 may detect the length of a medium based on the second media signal from the second media sensor 220 in Step S204. In this case, the length detection unit 152 waits until the trailing end of the medium passes the second media sensor 220 in Step S203. The length detection unit 152 periodically acquires the second media signal from the second media sensor 220 and determines that the leading end of the medium has passed the second media sensor 220 when the signal value of the second media signal changes from a value indicating that the absence of a medium to a value indicating the presence of a medium. The length detection unit 152 calculates the elapsed time from when the leading end of the medium passes the second media sensor 220 to when the trailing end of the medium passes the second media sensor 220. The length detection unit 152 obtains the detected length of the medium by multiplying the calculated elapsed time by the medium conveying speed. The length detection unit 152 may detect the length of the medium based on the motor drive amount that is to drive the feed roller 112, during the calculated elapsed time.

As described above, the medium conveying apparatus 200 that uses the second media sensor 220 also can start feeding the next medium with appropriate timing and feed each medium with more appropriate timing while preventing a media multi-feed.

Figure 11:
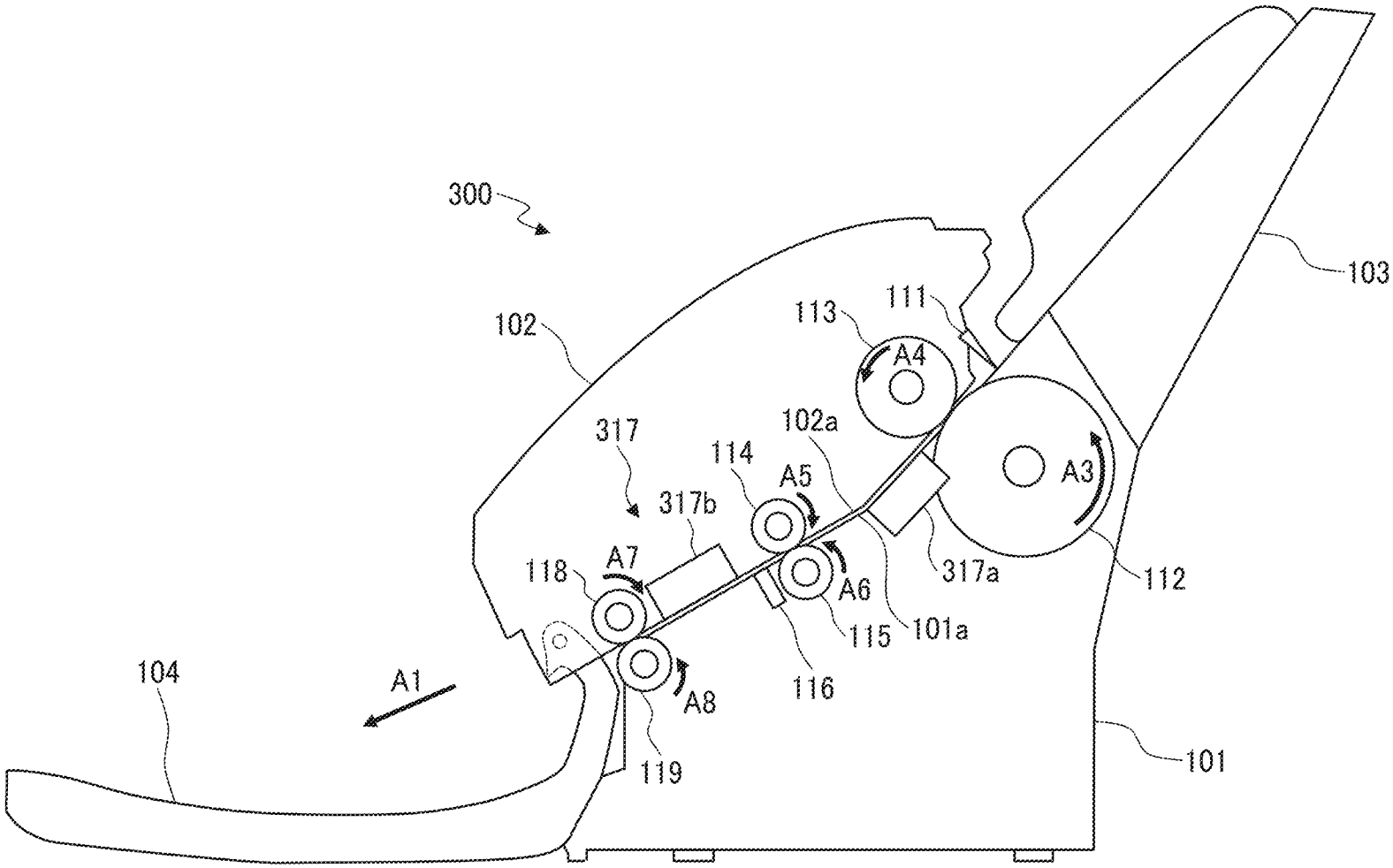
FIG. 11 is a diagram for explaining a conveyance path inside a medium conveying apparatus according to still another embodiment.

FIG. 11 is a diagram for explaining a conveyance path inside a medium conveying apparatus according to still another embodiment.

A medium conveying apparatus 300 illustrated in FIG. 11 has substantially the same configuration and functions as the medium conveying apparatus 100. The medium conveying apparatus 300 includes an imaging device 317 instead of the imaging device 117 included in the medium conveying apparatus 100. The imaging device 317 includes an image sensor. The media sensor 116 may be omitted from the medium conveying apparatus 300.

The imaging device 317 is an example of a detection unit and a second detection unit. The imaging device 317 includes a first imaging device 317*a* and a second imaging device 317*b* and images a medium. The first imaging device 317*a* and the second imaging device 317*b* have substantially the same configuration and functions as the first imaging device 117*a* and the second imaging device 117*b*, respectively. However, the first imaging device 317*a* and the second imaging device 317*b* are located at different positions from each other in the medium conveying direction A1. This means that the first imaging device 317*a* and the second imaging device 317*b* do not face each other. The first imaging device 317*a* is located upstream from the first conveyance roller 114 and the second conveyance roller 115, and the second imaging device 317*b* is located downstream side from the first conveyance roller 114 and the second conveyance roller 115. The first imaging device 317*a* may be located downstream from the first conveyance roller 114 and the second conveyance roller 115, and the second imaging device 317*b* may be located upstream from the first conveyance roller 114 and the second conveyance roller 115.

The first imaging device 317*a* and the second imaging device 317*b* may be located downstream from the first conveyance roller 114 and the second conveyance roller 115 at the different positions in the medium conveying direction A1.

When the media conveying process of FIG. 5 and the imaging process of FIG. 8 are executed by the medium conveying apparatus 300, the control unit 151 determines that the leading end of the medium has reached the imaging start position when the third period has elapsed from the start of the feeding of the medium in Step S201 of FIG. 8.

In Step S104 of FIG. 5, the control unit 151 waits until the leading end of the medium passes (the imaging position of) one of the first imaging device 317*a* and the second imaging device 317*b* that is located downstream. The control unit 151 sequentially acquires the line images from the imaging device and detects the leading end of the medium using a known image processing technique. In Step S107 of FIG. 5, the second distance is set to the distance from the imaging position of the imaging device located downstream to the specific position P2.

In Step S108 of FIG. 5, the control unit 151 determines whether the trailing end of the medium passes (the imaging position of) the one of the first imaging device 317*a* and the second imaging device 317*b* that is located upstream. The control unit 151 sequentially acquires the line images from the imaging device and detects the trailing end of the medium using a known image processing technique. Similarly, in Step S110 of FIG. 5, the control unit 151 determines whether the trailing end of the medium has passed the imaging device located upstream, thus, the control unit 151 waits until the trailing end of the medium passes the imaging device.

In Step S113 of FIG. 5, the control unit 151 determines that the trailing end of the medium has passed the third conveyance roller 118 and the fourth conveyance roller 119 when a fifth period has elapsed since the trailing end of the medium passed one of the first imaging device 317*a* and the second imaging device 317*b*. The fifth period is set to the time for the medium to be moved the distance between (the imaging position of) the imaging device and the pair of the third conveyance roller 118 and the fourth conveyance roller 119.

In Step S203 of FIG. 8, the length detection unit 152 determines whether the trailing end of the medium has passed one of the first imaging device 317*a* and the second imaging device 317*b*, thus, the length detection unit 152 waits until the trailing end of the medium passes the imaging device. In Step S204, the length detection unit 152 calculates the elapsed time from when the leading end of the medium passes the imaging device to when the trailing end of the medium passes the imaging device. The length detection unit 152 obtains the detected length of the medium by multiplying the calculated elapsed time by the medium conveying speed. The length detection unit 152 may detect the length of the medium based on the motor drive amount that is to drive the feed roller 112, during the calculated elapsed time.

In Step S208, the control unit 151 determines whether the trailing end of the medium has passed the one of the first imaging device 317*a* and the second imaging device 317*b* that is located downstream, thus, the control unit 151 waits until the trailing end of the medium passes the imaging device.

The media sensor 116 may be used as a detection unit, and the imaging device 317 may be used as a second detection unit. In this case, in Step S104 of FIG. 5, the control unit 151 waits until the leading end of the medium passes the media sensor 116. In Step S108, the control unit 151 determines whether the trailing end of the medium has passed (the imaging position of) the one of the first imaging device 317*a* and the second imaging device 317*b* that is located upstream. The medium conveying apparatus 300 may include the second media sensor 220, the imaging device 317 may be used as a detection unit, and the second media sensor 220 may be used as a second detection unit. In this case, in Step S104 of FIG. 5, the control unit 151 waits until the leading end of the medium passes (the imaging position of) the one of the first imaging device 317*a* and the second imaging device 317*b* that is located downstream. In Step S108, the control unit 151 determines whether the trailing end of the medium has passed the second media sensor 220. In these cases, one of the first imaging device 317*a* and the second imaging device 317*b* may be omitted.

As described above, the medium conveying apparatus 300 that uses the imaging device 317 also can start feeding the next medium with appropriate timing and feed each medium with more appropriate timing while preventing a media multi-feed.

In particular, the medium conveying apparatus 300 can start feeding the next medium before the trailing end of a small-sized medium passes the imaging device located downstream and can feed multiple small-sized media in a shorter time similarly to the medium conveying apparatus 200. Further, the medium conveying apparatus 300 can start feeding the next medium before the trailing end of a large-sized medium passes the imaging device located downstream and can feed multiple large-sized media in a shorter time similarly to the medium conveying apparatus 200. Further, the medium conveying apparatus 300 can appropriately determine the timing to start feeding a medium without using a special sensor for determining the timing to start feeding the medium similarly to the medium conveying apparatus 100. Accordingly, the medium conveying apparatus 300 can more effectively increase the processing performance of the media conveying process while preventing an increase in the apparatus cost and the power consumption.

Figure 12:
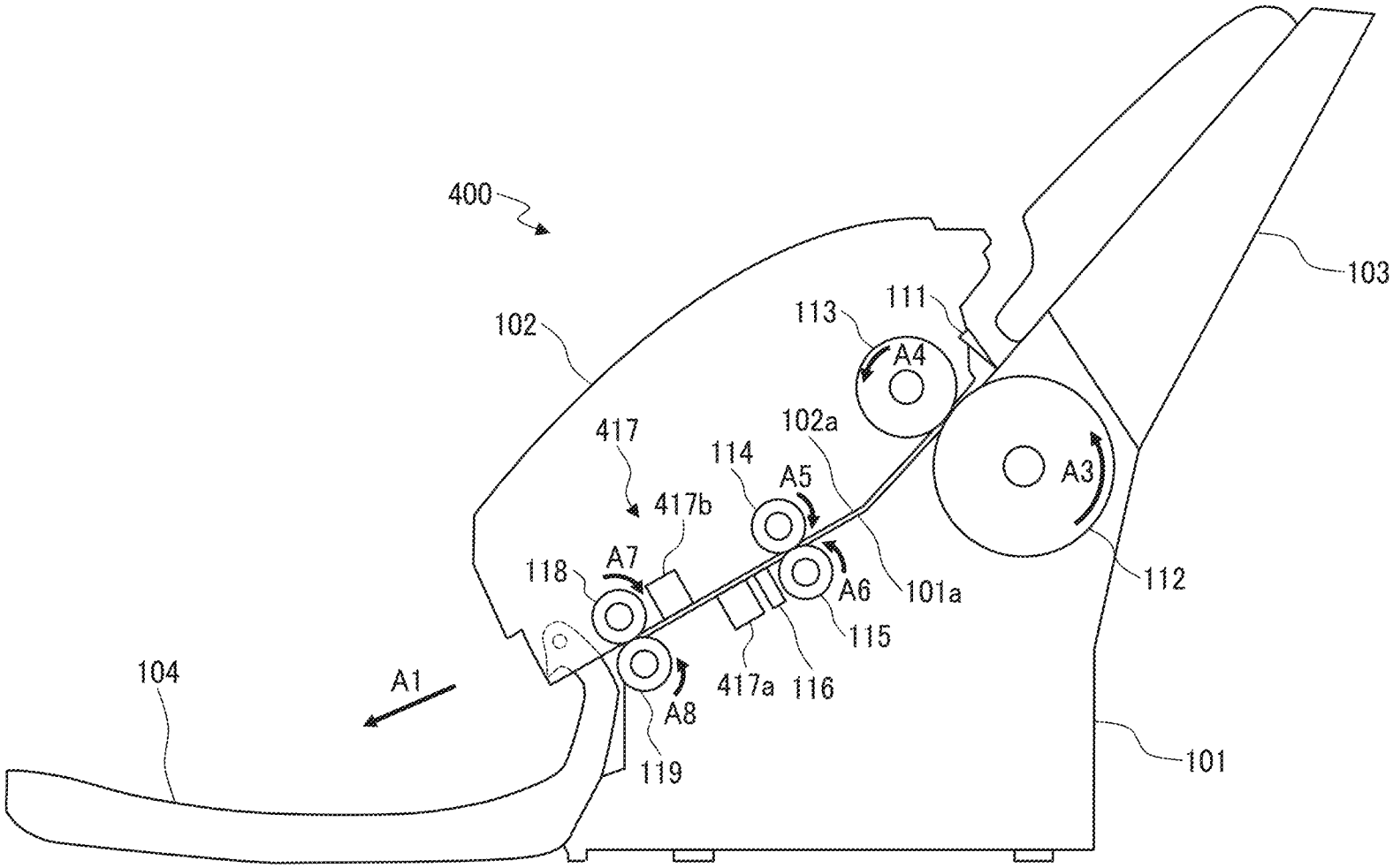
FIG. 12 is a diagram for explaining a conveyance path inside a medium conveying apparatus according to still another embodiment.

FIG. 12 is a diagram for explaining a conveyance path inside a medium conveying apparatus according to still another embodiment.

A medium conveying apparatus 400 illustrated in FIG. 12 has substantially the same configuration and functions as the medium conveying apparatus 100. The medium conveying apparatus 400 includes an imaging device 417 instead of the imaging device 117 included in the medium conveying apparatus 100. The imaging device 417 includes a first imaging device 417*a* and a second imaging device 417*b*. Each of the first imaging device 417*a* and the second imaging device 417 includes an image sensor. The configurations and functions of the first imaging device 417*a* and the second imaging device 417*b* are substantially the same as those of the first imaging device 117*a* and the second imaging device 117*b*, respectively. However, the first imaging device 417*a* and the second imaging device 417*b* are located at different positions from each other in the medium conveying direction A1. Therefore, the first imaging device 417*a* and the second imaging device 417*b* do not face each other. In addition to the pair of the first conveyance roller 114 and the second conveyance roller 115 and the pair of the third conveyance roller 118 and the fourth conveyance roller 119, another conveyance roller pair may be located between the first imaging device 417*a* and the second imaging device 417*b* in the medium conveying direction A1.

As described above, the medium conveying apparatus 400 that uses the imaging device 417 also can start feeding the next medium with appropriate timing and feed each medium with more appropriate timing while preventing a media multi-feed.

Figure 13:
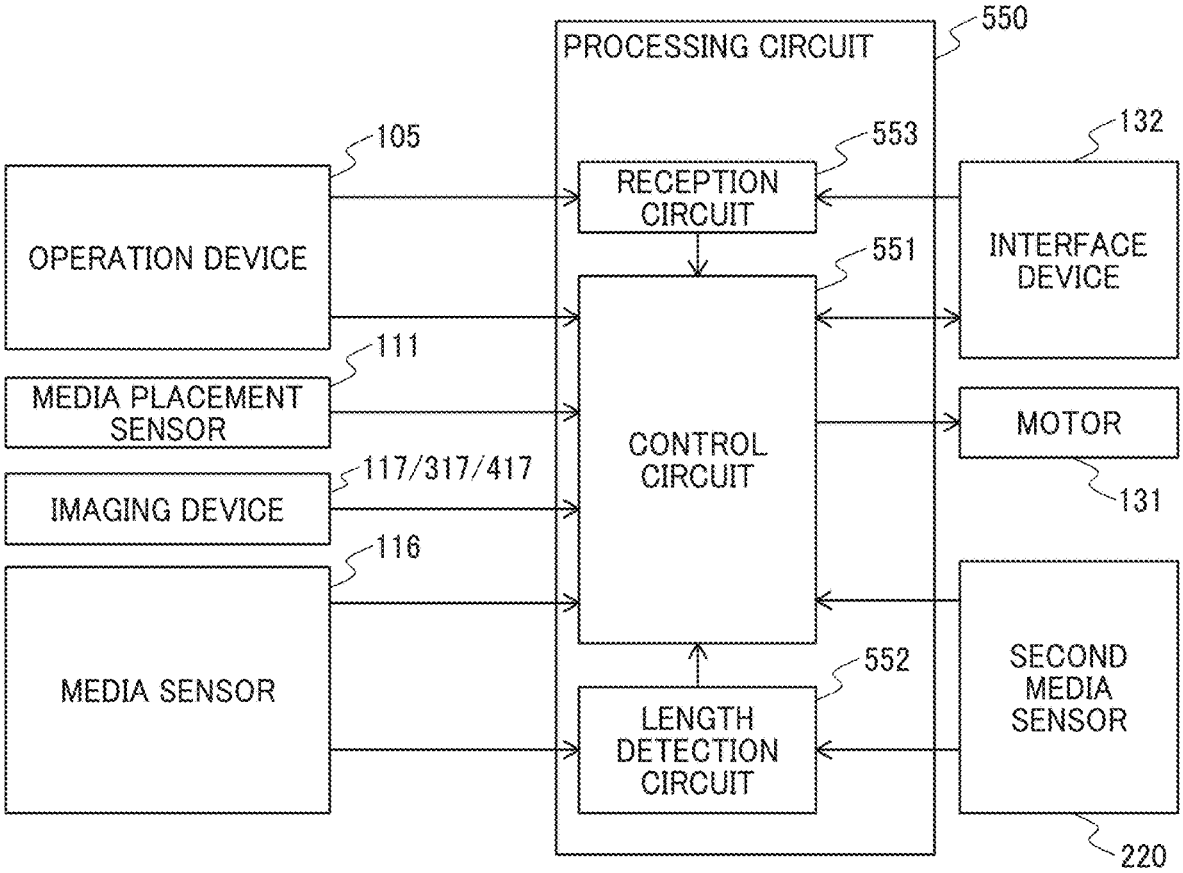
FIG. 13 is a schematic diagram of a configuration of a processing circuit according to still another embodiment.

FIG. 13 is a schematic block diagram of a configuration of a processing circuit of a medium conveying apparatus according to still another embodiment.

A processing circuit 550 is used instead of the processing circuit 150 of the medium conveying apparatus 100 and executes processes including the media conveying process and the imaging process instead of the processing circuit 150. The processing circuit 550 includes a control circuit 551, a length detection circuit 552, and a reception circuit 553. These circuits may be implemented by independent integrated circuits, microprocessors, firmware, or a combination thereof.

The control circuit 551 is an example of a control unit and functions like the control unit 151. The control circuit 551 receives operation signals from the operation device 105 or the interface device 132, placement signals from the media placement sensor 111, medium signals from the media sensor 116, and second media signals from the second media sensor 220. The control circuit 551 also receives the length of a medium from the length detection circuit 552 and the predetermined amount and the threshold from the reception circuit 553. The control circuit 551 controls the motor 131 based on the received information, acquires line images from the imaging device 117, 317, or 417 to generate an input image, and outputs the input image to the interface device 132.

The length detection circuit 552 is an example of a length detection unit and has substantially the same function as the length detection unit 152. The length detection circuit 552 receives the media signal from the media sensor 116 and the second media signal from the second media sensor 220. The length detection circuit 552 detects the length of the medium based on the received signals and outputs the detected length to the control circuit 551.

The reception circuit 553 is an example of a reception unit and has substantially the same function as the reception unit 153. The reception circuit 553 receives the predetermined amount and the threshold set by the user from the operation device 105 or the interface device 132 and outputs the predetermined amount and the threshold to the control circuit 551.

As described above, the medium conveying apparatus that uses the processing circuit 550 also can start feeding the next medium with appropriate timing and feed each medium with more appropriate timing while preventing a media multi-feed.

According to one aspect of the present disclosure, a medium conveying apparatus, a medium conveying method, and a control program can feed a medium with more appropriate timing.

Although several embodiments have been described above, the embodiments are not limited thereto. For example, the medium conveying apparatus may also have a so-called U-turn path, feed and convey media placed on the media tray sequentially from the top, and eject the media to the ejection tray. In this case, the feed roller is located above the separation roller to face the separation roller. The medium conveying apparatus in this case also can start feeding the next medium with appropriate timing and feed each medium with more appropriate timing while preventing a media multi-feed.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

Any one of the above-described operations may be performed in various other ways, for example, in an order different from the one described above.

The functionality of the elements disclosed herein may be implemented using circuitry or processing circuitry which includes general purpose processors, special purpose processors, integrated circuits, application-specific integrated circuits (ASICs), field-programmable gate arrays (FPGAs), and/or combinations thereof which are configured or programmed, using one or more programs stored in one or more memories, to perform the disclosed functionality. Processors are considered processing circuitry or circuitry as they include transistors and other circuitry therein. In the disclosure, the circuitry, units, or means are hardware that carry out or are programmed to perform the recited functionality. The hardware may be any hardware disclosed herein which is programmed or configured to carry out the recited functionality.

There is a memory that stores a computer program which includes computer instructions. These computer instructions provide the logic and routines that enable the hardware (e.g., processing circuitry or circuitry) to perform the method disclosed herein. This computer program can be implemented in known formats as a computer-readable storage medium, a computer program product, a memory device, a record medium such as a CD-ROM or DVD, and/or the memory of an FPGA or ASIC.

The invention claimed is:

1. A medium conveying apparatus, comprising:

a feed roller to feed a medium;

a conveyance roller pair located downstream from the feed roller in a medium conveying direction;

a sensor located downstream from the conveyance roller pair in the medium conveying direction; and circuitry configured to start feeding a next medium when the medium is conveyed by a predetermined amount after a leading end of the medium passes the sensor, wherein the circuitry starts feeding the next medium when a trailing end of the medium passes the sensor before the medium is conveyed by the predetermined amount after the leading end of the medium passes the sensor.

2. The medium conveying apparatus according to claim 1, wherein the circuitry is further configured to obtain a length of the medium, and in a case where the length of the medium is greater than a threshold, the circuitry starts feeding a subsequent medium that is subsequent to the next medium when a trailing end of the next medium passes the sensor.

3. The medium conveying apparatus according to claim 2, wherein the circuitry is further configured to receive a setting for the threshold.

4. The medium conveying apparatus according to claim 1, wherein the sensor is a light detection sensor that includes a light emitter to emit light to a medium conveyance path and a light receiver to receive the light emitted by the light emitter.

5. The medium conveying apparatus according to claim 1, wherein the sensor is an imaging sensor to image the medium.

6. The medium conveying apparatus according to claim 1, wherein the circuitry is further configured to receive a setting for the predetermined amount.

7. A medium conveying method, comprising:

feeding a medium with a feed roller; and starting to feed a next medium when the medium is conveyed by a predetermined amount after a leading end of the medium passes a sensor located downstream from a conveyance roller pair in a medium conveying direction, wherein the conveyance roller pair is located downstream from the feed roller in the medium conveying direction, wherein feeding the next medium is started when a trailing end of the medium passes the sensor before the medium is conveyed by the predetermined amount after the leading end of the medium passes the sensor.

8. A computer-readable, non-transitory medium storing a computer program, wherein the computer program causes a medium conveying apparatus including a feed roller to feed a medium, a conveyance roller pair located downstream from the feed roller in a medium conveying direction, and a sensor located downstream from the conveyance roller pair in the medium conveying direction, to execute a process, the process comprising starting to feed a next medium when the medium is conveyed by a predetermined amount after a leading end of the medium passes a sensor, wherein feeding the next medium is started when a trailing end of the medium passes the sensor before the medium is conveyed by the predetermined amount after the leading end of the medium passes the sensor.

* * * * *